US010926561B2

(12) United States Patent
Kondo et al.

(10) Patent No.: US 10,926,561 B2
(45) Date of Patent: Feb. 23, 2021

(54) HEAD UNIT AND LIQUID-DISCHARGING APPARATUS

(71) Applicant: SEIKO EPSON CORPORATION, Tokyo (JP)

(72) Inventors: Yoichiro Kondo, Nagano (JP); Fumiya Takino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/511,020

(22) Filed: Jul. 15, 2019

(65) Prior Publication Data

US 2020/0023661 A1 Jan. 23, 2020

(30) Foreign Application Priority Data

| | | |
|---|---|---|
| Jul. 17, 2018 | (JP) | JP2018-134267 |
| Mar. 20, 2019 | (JP) | JP2019-052210 |
| Mar. 20, 2019 | (JP) | JP2019-052211 |
| Mar. 20, 2019 | (JP) | JP2019-052212 |

(51) Int. Cl.
*B41J 2/14* (2006.01)
*B41J 29/377* (2006.01)

(52) U.S. Cl.
CPC ..... *B41J 29/377* (2013.01); *B41J 2/14201* (2013.01)

(58) Field of Classification Search
None
See application file for complete search history.

(56) References Cited

U.S. PATENT DOCUMENTS

| | | | | |
|---|---|---|---|---|
| 6,631,966 | B2 * | 10/2003 | Watanabe | B41J 2/1408 347/18 |
| 7,510,271 | B2 * | 3/2009 | Owaki | B41J 2/14233 347/68 |
| 8,936,355 | B2 * | 1/2015 | Wakamatsu | B41J 2/14233 347/68 |

FOREIGN PATENT DOCUMENTS

| | | |
|---|---|---|
| JP | 2003-136734 A | 5/2003 |
| JP | 2015-150830 A | 8/2015 |
| JP | 2016-164004 A | 9/2016 |
| JP | 2018-039174 A | 3/2018 |

OTHER PUBLICATIONS

The Partial European Search Report for the corresponding European Patent Application No. 19186199.6 dated Dec. 5, 2019.

* cited by examiner

*Primary Examiner* — Alejandro Valencia
(74) *Attorney, Agent, or Firm* — Global IP Counselors, LLP

(57) ABSTRACT

A head unit has: a first member in which a pressure chamber that stores a liquid to be discharged from a nozzle is formed; a piezoelectric element disposed on the first member and configured to deform in response to a driving signal; a first substrate disposed on the first member so as to cover the piezoelectric element; an integrated circuit disposed on the first substrate, and configured to supply the driving signal to the piezoelectric element; a second member disposed on the first member, and the second member including a holding chamber configured to hold the liquid, and a heat dissipation opening configured to dissipate heat of the integrated circuit; and a third member formed from a metal, the third member being disposed on the second member. The heat dissipation opening is located between the integrated circuit and the third member.

13 Claims, 19 Drawing Sheets

HEAD UNIT AND LIQUID-DISCHARGING APPARATUS

The present application is based on, and claims priority from JP Application Serial Number 2018-134267, filed Jul. 17, 2018, JP Application Serial Number 2019-052210, filed Mar. 20, 2019, JP Application Serial Number 2019-052211, filed Mar. 20, 2019, and JP Application Serial Number 2019-052212, filed Mar. 20, 2019, the disclosures of which are hereby incorporated by reference herein in their entirety.

BACKGROUND

1. Technical Field

The present disclosure relates to a head unit and a liquid-discharging apparatus.

2. Related Art

A head unit proposed in related art forms an image on a recording medium by discharging a liquid such as an ink from nozzles. JP-A-2018-039174, for example, discloses a head unit that has a piezoelectric element driven by a driving signal, an integrated circuit that includes a switch circuit making a switchover as to whether to supply a driving signal to the piezoelectric element, the piezoelectric element being provided on a rigid wiring substrate, and a pressure chamber that enables a liquid to be discharged from nozzles according the driving of the piezoelectric element.

A driving signal that drives a piezoelectric element has a large amplitude. Therefore, when a switch circuit supplies a driving signal to the piezoelectric element, the switch circuit generates heat. When heat generated in the switch circuit is transmitted to the liquid in a pressure chamber through a rigid wiring substrate, the temperature of the liquid in the pressure chamber may rise. Then, the property of the liquid discharged from the pressure chamber changes. This is problematic in that the quality of an image formed by the liquid discharged from the head unit is lowered.

SUMMARY

To solve the above problem, a head unit according a preferred aspect of the present disclosure has: a first member in which a pressure chamber that stores a liquid to be discharged from a nozzle is formed; a piezoelectric element disposed on the pressure chamber, the piezoelectric element undergoing a displacement in response to a driving signal; a first substrate disposed on the first member so as to cover the piezoelectric element; an integrated circuit disposed on the first substrate, the integrated circuit supplying the driving signal to the piezoelectric element; a second member disposed on the first member, a holding chamber being formed in the second member, the liquid being held in the holding chamber; and a third member formed from a metal, the third member being disposed on the second member. In the second member, a heat dissipation opening for dissipating heat generated in the integrated circuit is formed between the integrated circuit and the third member.

A head unit according a preferred aspect in the present disclosure has: a first member in which a pressure chamber that stores a liquid to be discharged from a nozzle is formed; a piezoelectric element disposed on the pressure chamber, the piezoelectric element undergoing a displacement in response to a driving signal; a first substrate disposed on the first member so as to cover the piezoelectric element; an integrated circuit disposed on the first substrate, the integrated circuit supplying the driving signal to the piezoelectric element; a second member disposed on the first member, a holding chamber being formed in the second member, the liquid being held in the holding chamber; and a third member formed from a metal, the third member being disposed on the second member. The third member has a first structural body and a second structural body. The piezoelectric device, the integrated circuit, and the first substrate are disposed between the first structural body and the second structural body.

DESCRIPTION OF EXEMPLARY EMBODIMENTS

Figure 1:
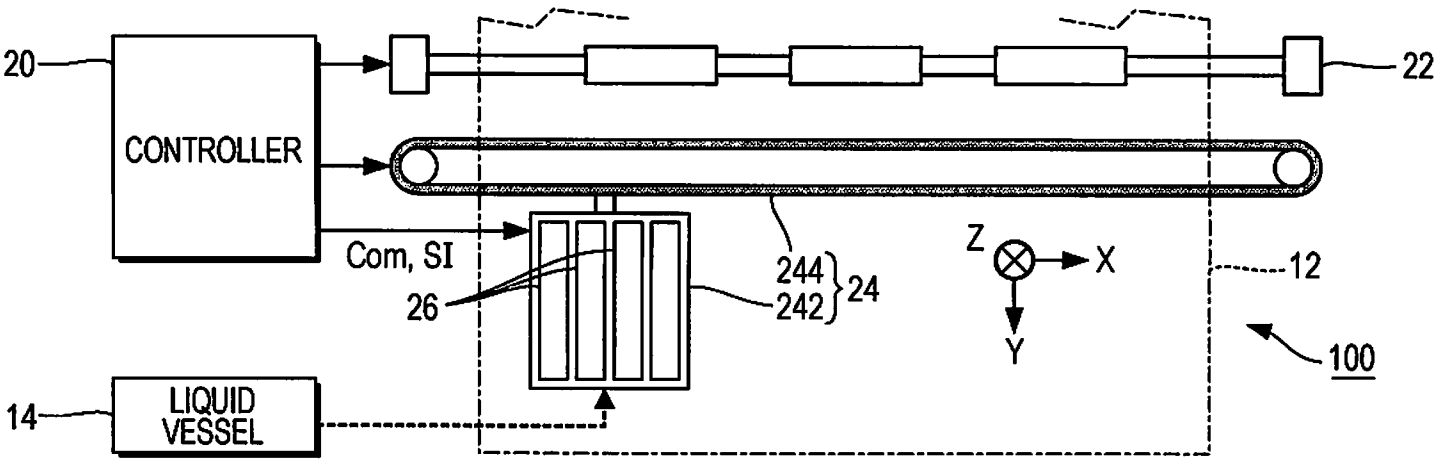
FIG. 1 illustrates the structure of an example of a liquid-discharging apparatus according an embodiment of the present disclosure.

An embodiment of the present disclosure will be described below with reference to the drawings. The dimensions and scales of individual sections and portions in the drawings differ from their actual dimensions and scales, as appropriate. Since an embodiment described below is a preferred specific example in the present disclosure, various limitations that are desirable from a technical viewpoint have been added. However, the scope of the present disclosure is not limited to these forms unless, in the explanation below, there is a particular description that limits the present disclosure.

A. Embodiment

A liquid-discharging apparatus 100 according to this embodiment will be described with reference to FIGS. 1 to 7.

1. Outline of the Liquid-Discharging Apparatus

FIG. 1 illustrates the structure of the liquid-discharging apparatus 100 according to this embodiment. The liquid-discharging apparatus 100 according to this embodiment is an ink jet printing apparatus that discharges an ink, which is an example of a liquid, to a medium 12. Although the medium 12 is typically a print sheet, any media, such as a resin film or a fabric cloth, on which printing is performed can be used as the medium 12.

As illustrated in FIG. 1, the liquid-discharging apparatus 100 has a liquid vessel 14 that hold inks. Examples of the liquid vessel 14 include cartridges that can be attached to and removed from the liquid-discharging apparatus 100, pouched ink packs formed from a flexible film, and ink tanks that can be refilled with inks. A plurality of types of inks in different colors are held in the liquid vessel 14.

As illustrated in FIG. 1, the liquid-discharging apparatus 100 has a controller 20, a transport mechanism 22, a moving mechanism 24, and a plurality of head units 26.

In this embodiment, the controller 20 includes a processing circuit, such as a central processing unit (CPU) or a field-programmable gate array (FPGA), and a storage circuit such as a semiconductor memory, for example. The liquid-discharging apparatus 100 controls individual elements.

In this embodiment, the transport mechanism 22 transports the medium 12 in the +Y direction under control of the controller 20. In the description below, the +Y direction and −Y direction, which is opposite to the +Y direction, will be collectively referred to as the Y-axis direction.

In this embodiment, the moving mechanism 24 reciprocates the plurality of head units 26 in the +X direction and −X direction, which is opposite to the +X direction, under control of the controller 20. The +X direction crosses the +Y direction in which the medium 12 is transported. Typically, the +X direction is orthogonal to the +Y direction. In the description below, the +X direction and −X direction will be collectively referred to as the X-axis direction.

The moving mechanism 24 has a storage case 242 that accommodates the plurality of head units 26 and also has an endless belt 244 to which the storage case 242 is fixed. It is also possible to store the liquid vessel 14 in the storage case 242 together with the head units 26.

An ink is supplied from the liquid vessel 14 to the head unit 26. A driving signal Com that drives the head unit 26 and a control signal SI that controls the head unit 26 are also supplied from the controller 20 to the head unit 26. The head unit 26 is driven by the driving signal Com under control of the control signal SI and discharges an ink from part or all of 2M nozzles N in the +Z direction, M being a natural number equal to or larger than 1. The +Z direction crosses the +X direction and +Y direction. Typically, the +Z direction is orthogonal to the +X direction and +Y direction. In the description below, the +Z direction and the −Z direction, which is opposite to the +Z direction, will sometimes be collectively referred to as the Z-axis direction. The nozzle N will be described later with reference to FIGS. 3 and 4.

The head unit 26 discharges an ink from part or all of the 2M nozzles N in synchronization with the transport of the medium 12 by the transport mechanism 22 and the reciprocating motion of the storage case 242. The discharged ink is landed on the front surface of the medium 12, forming a desired image on the front surface of the medium 12.

Figure 2:
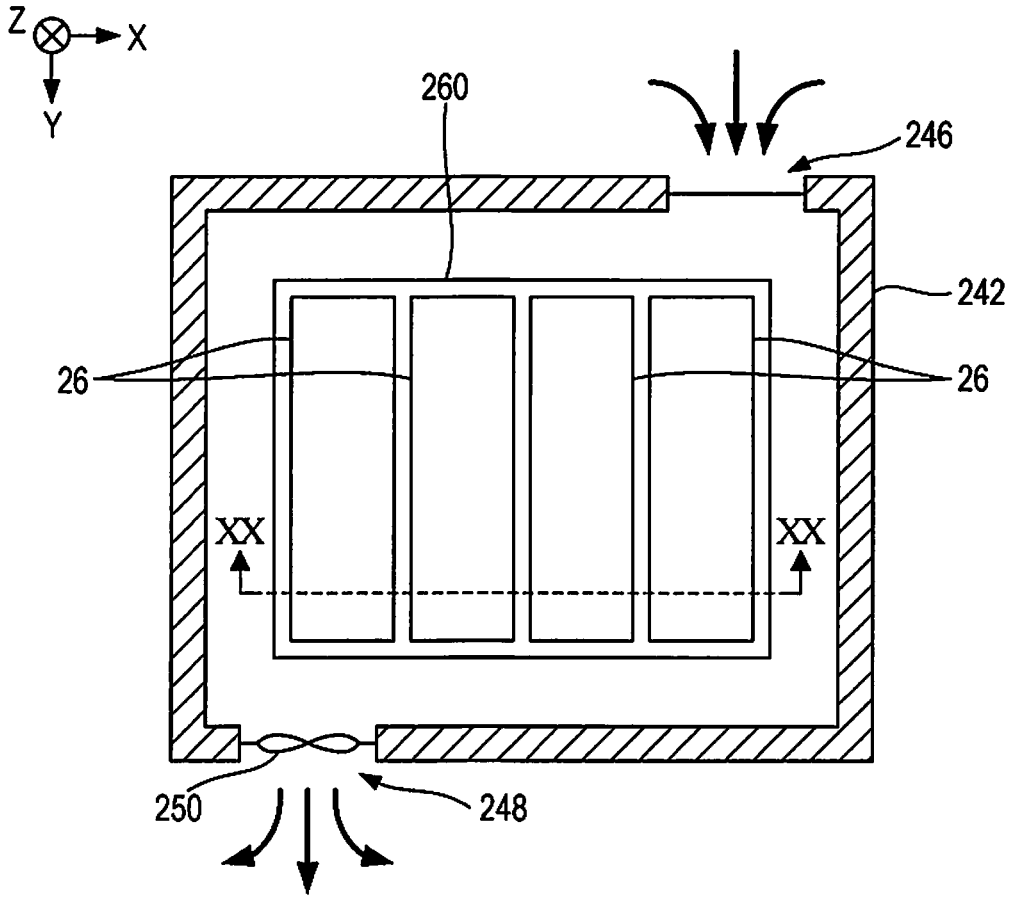
FIG. 2 illustrates an example of the outline of a storage case.

FIG. 2 illustrates the storage case 242 and the plurality of head units 26 stored in the storage case 242.

In this embodiment, the storage case 242 internally stores a head module 260 in which four head units 26 are included, as illustrated in FIG. 2. The storage case 242 has an intake port 246 through which air outside the storage case 242 is taken into the storage case 242 and an exhausting port 248 through which air in the storage case 242 is exhausted the outside of the storage case 242. Furthermore, the exhausting port 248 has a fan 250 that exhausts air in the storage case 242 to the outside of the storage case 242. In this embodiment, air is an example of a gas.

2. Structure of the Head Unit

The head unit 26 will be outlined below with reference to FIGS. 3 to 5.

Figure 3:
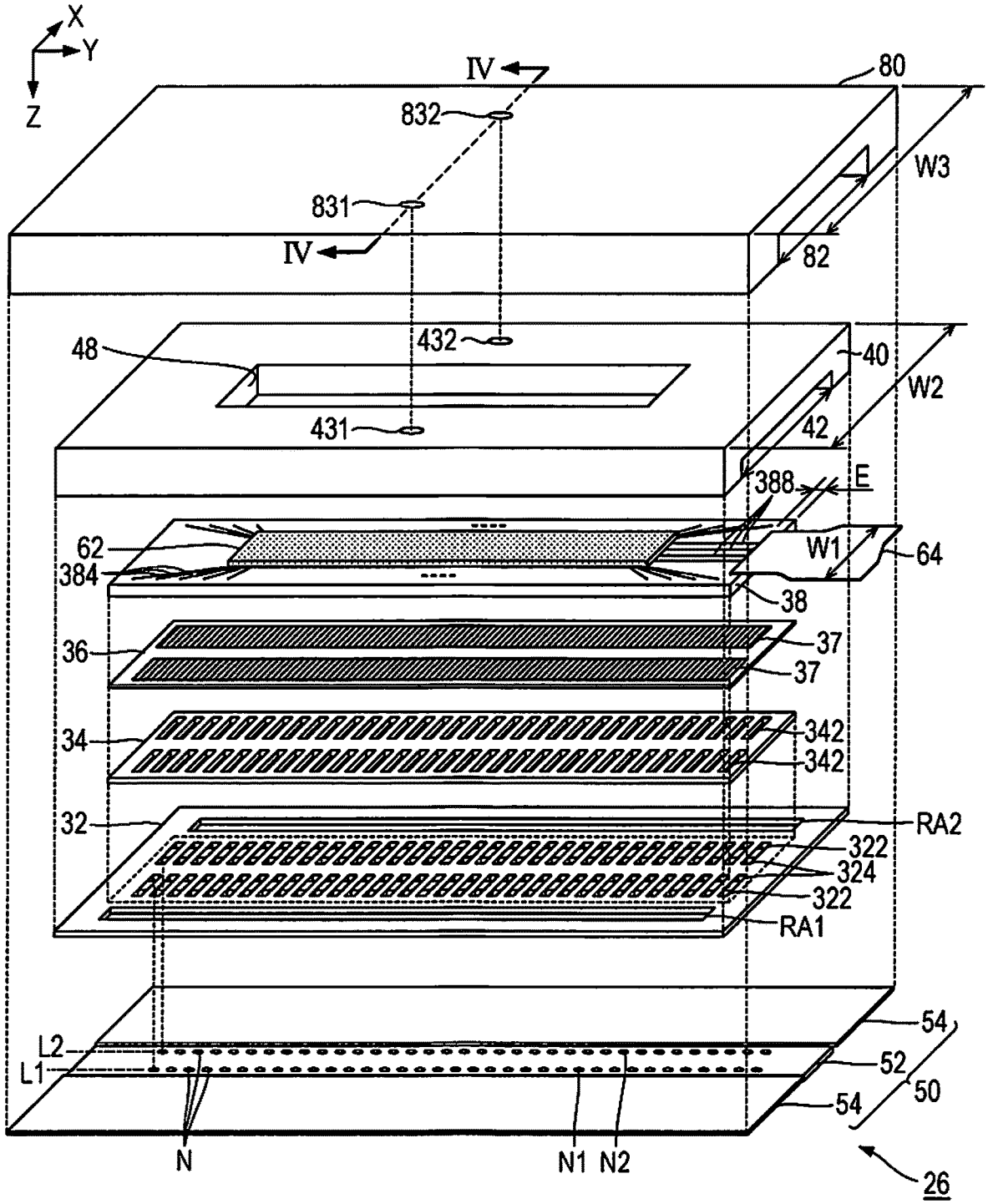
FIG. 3 is an exploded perspective view illustrating the structure of an example of a head unit.

FIG. 3 is an exploded perspective view of the head unit 26. FIG. 4 is a cross-sectional view taken along line IV-IV in FIG. 3.

Figure 4:
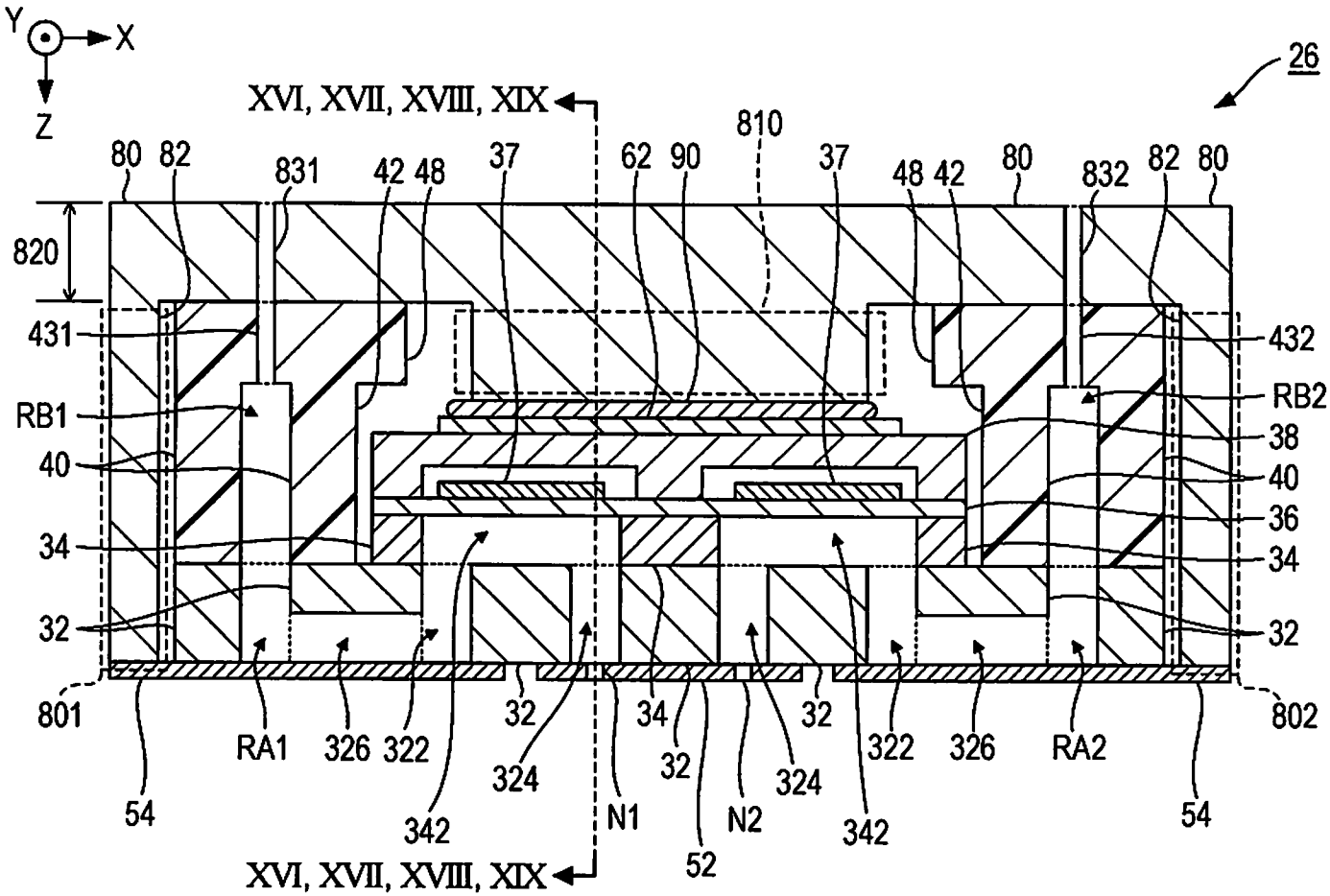
FIG. 4 is a cross-sectional view illustrating the structure of the head unit in FIG. 3.

As illustrated in FIGS. 3 and 4, the head unit 26 has a nozzle substrate 50 that includes a nozzle plate 52 and vibration absorbing bodies 54, a flow path substrate 32, a pressure chamber substrate 34, a vibrating section 36, a plurality of piezoelectric elements 37, a rigid wiring substrate 38, an integrated circuit 62 including a switch circuit, a holding chamber forming substrate 40, and an external case 80.

In this embodiment, a combination of the flow path substrate 32, pressure chamber substrate 34, and vibrating section 36 is an example of a first member, the rigid wiring substrate 38 is an example of a first substrate, the holding chamber forming substrate 40 is an example of a second member, and the external case 80 is an example of a third member.

The nozzle plate 52 is a plate-like member that is elongated in the Y-axis direction and extends in substantially parallel to an XY plane. On the nozzle plate 52, 2M nozzles N are formed. Here, "substantially parallel" indicates not only that the nozzle plate 52 is completely parallel to an XY plane but also that when error is taken into consideration, the nozzle plate 52 can be regarded to be parallel to an XY plane.

Each nozzle N is a hole formed in the nozzle plate 52. The nozzle plate 52 is manufactured by, for example, using a semiconductor manufacturing technology such as etching to process a monocrystalline silicon substrate. In the manufacturing of the nozzle plate 52, however, any known material and any known manufacturing method can be used.

In this embodiment, the 2M nozzles N are disposed in two rows, a row L1 and a row L2, which is positioned closer to the +X side than is the row L1, on the nozzle plate 52. In the description below, each of the M nozzles N included in the row L1 will sometimes be referred to as the nozzle N1 and each of the M nozzles N included in the row L2 will sometimes be referred to as the nozzle N2.

In this embodiment, a case will be assumed as an example in which there is a substantially match in positions in the Y-axis direction between the m-th nozzle N1, from the −Y side, of the M nozzles N1 in the row L1 and the m-th nozzle N2, from the −Y side, of the M nozzles N2 in the row L2. Here, m is a natural number in the range of 1 to M. "Substantial match" indicates not only that there is a complete match between the two positions but also that when error is taken into consideration, it can be regarded that there is a match between the two positions. However, the 2M nozzles N may be arranged so that there is a mismatch positions in the Y-axis direction between the m-th nozzle N1, from the −Y side, of the M nozzles N1 in the row L1 and the m-th nozzle N2, from the −Y side, of the M nozzles N2 in the row L2.

This embodiment assumes that the M nozzles N in each of the row L1 and row L2 is provided with a density of 400 or more nozzles N per inch on the nozzle plate 52. This embodiment also assumes that 800 or more nozzles N are provided on the nozzle plate 52. That is, this embodiment assumes that M is a natural number equal to or larger than 400.

The external case 80 is disposed on the surface of the nozzle substrate 50 on the −Z side.

The external case 80 has an upper lid 820 in a plate shape that is elongated in the Y-axis direction and extends in substantially parallel to an XY plane, a side surface 801 that is elongated in the Y-axis direction and extends in substantially parallel to an YZ plane, and a side surface 802 that is elongated in the Y-axis direction and extends in substantially parallel to an YZ plane on a side closer to the +X side than is the side surface 801. That is, the external case 80 has a concave portion 82 composed of the surface of the upper lid 820 on the +Z side, the surface of the side surface 801 on the +X side, and the surface of the side surface 802 on the −X side. In the description below, a space that is closer to the +Z side than is the upper lid 820, closer to the +X side than is the side surface 801, and closer to the −X side than is the side surface 802 will be referred to as the space inside the concave portion 82. As is clear from form FIG. 4, the space inside the concave portion 82 can also be considered as a space between the nozzle substrate 50 and the external case 80.

In this embodiment, the side surface 801, which is an example of a first structural body, is fixed to the surface of the nozzle substrate 50 on the −Z side. Also, in this embodiment, the side surface 802, which is an example of a second structural body, is fixed to the surface of the nozzle substrate 50 on the −Z side.

In the space inside the concave portion 82, the external case 80 also has a convex portion 810 in a rectangular parallelepiped shape on the surface of the upper lid 820 on the +Z side. The convex portion 810 is elongated in the Y-axis direction.

The external case 80 including the upper lid 820, side surface 801, side surface 802, and convex portion 810 is formed from, for example, a metal material having thermal conductivity equal to or higher than prescribed thermal conductivity. The prescribed thermal conductivity is higher than the thermal conductivity of, for example, the nozzle substrate 50, flow path substrate 32, pressure chamber substrate 34, vibrating section 36, piezoelectric element 37, rigid wiring substrate 38, holding chamber forming substrate 40, and ink. This embodiment assumes that the prescribed thermal conductivity is set to 200 W/mK, as an example. In this embodiment, therefore, a metal such as aluminum or copper, for example, can be used as the material of the external case 80.

As illustrated in FIGS. 3 and 4, the flow path substrate 32 is disposed on the surface of the nozzle substrate 50 on the −Z side in the space inside the concave portion 82.

The flow path substrate 32 is a plate-like member that is elongated in the Y-axis direction and extends in substantially parallel to an XY plane. An ink flow path is formed in the flow path substrate 32. Specifically, in the flow path substrate 32, a flow path RA1 is formed in correspondence with the row L1 and a flow path RA2 is also formed in correspondence with the row L2. The flow path RA1 is an opening formed so as to be elongated in the Y-axis direction. The flow path RA2 is also an opening formed so as to be elongated along the Y-axis direction. The flow path RA2 is positioned along the +X direction when viewed from the flow path RA1.

In the flow path substrate 32, 2M flow paths 322 and 2M flow paths 324 are formed in one-to-one correspondence with the 2M nozzles N. As illustrated in FIG. 4, each flow path 322 and each flow path 324 are an opening formed so as to pass through the flow path substrate 32. The flow path 324 communicates with the nozzle N corresponding to that flow path 324.

Two flow paths 326 are formed on the surface of the flow path substrate 32 on the +Z side. One of the two flow paths 326 links the flow path RA1 and M flow paths 322 disposed in one-to-one correspondence with the M nozzles N1 in the row L1 together. The other of the two flow paths 326 links the flow path RA2 and M flow paths 322 disposed in one-to-one correspondence with the M nozzles N2 in the row L2 together.

The flow path substrate 32 is manufactured by, for example, using a semiconductor manufacturing technology to process a monocrystalline silicon substrate. In the manufacturing of the flow path substrate 32, however, any known material and any known manufacturing method can be used.

As illustrated in FIGS. 3 and 4, the pressure chamber substrate 34 is disposed on the surface of the flow path substrate 32 on the −Z side in the space inside the concave portion 82.

The pressure chamber substrate 34 is a plate-like member that is elongated in the Y-axis direction and extends in substantially parallel to an XY plane. In the pressure chamber substrate 34, 2M openings 342 are formed in one-to-one correspondence with the 2M nozzles N.

The pressure chamber substrate 34 is manufactured by, for example, using a semiconductor manufacturing technology to process a monocrystalline silicon substrate. In the manufacturing of the pressure chamber substrate 34, however, any known material and any known manufacturing method can be used.

As illustrated in FIGS. 3 and 4, the vibrating section 36 is disposed on the surface of the pressure chamber substrate 34 on the −Z side in the space inside the concave portion 82. The vibrating section 36 is a plate-like member that is elongated in the Y-axis direction and extends in substantially parallel to an XY plane. The vibrating section 36 can elastically vibrate.

As illustrated in FIG. 4, the surface of the flow path substrate 32 on the −Z side and the surface of the vibrating section 36 on the +Z side are placed so as to face each other with the opening 342 intervening between them. A space inside the opening 342, the space being positioned between the surface of the flow path substrate 32 on the −Z side and the surface of the vibrating section 36 on the +Z side, functions as a pressure chamber that applies pressure to the ink supplied in the space. That is, in this embodiment, the vibrating section 36 is an example of a vibrating plate that is one of the wall surfaces of the pressure chamber.

In the head unit 26, 2M pressure chambers are provided in one-to-one correspondence with the 2M nozzles N. As illustrated in FIG. 4, a pressure chamber provided for one nozzle N1 communicates with the flow path RA1 through the flow path 322 and flow path 326, and also communicates with the nozzle N1 through the flow path 324. Similarly, a pressure chamber provided for one nozzle N2 communicates with the flow path RA2 through the flow path 322 and flow path 326, and also communicates with the nozzle N2 through the flow path 324.

As illustrated in FIGS. 3 and 4, in the space inside the concave portion 82, 2M piezoelectric elements 37 are provided on the surface of the vibrating section 36 on the −Z side in one-to-one correspondence with the 2M pressure chambers. The piezoelectric element 37 is a passive device that deforms in response to a driving signal Com supplied to it.

Figure 5:
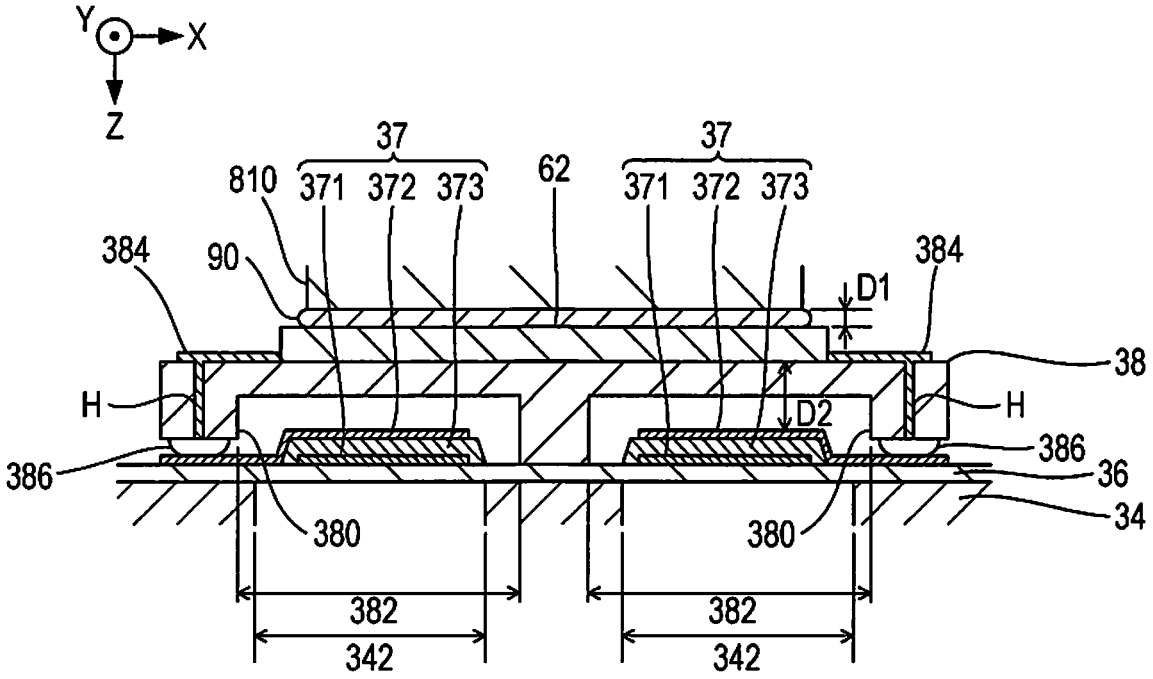
FIG. 5 is a cross-sectional view illustrating an example of a structure in the vicinity of piezoelectric elements.

FIG. 5 is a cross-sectional view in which the vicinity of the piezoelectric element 37 is enlarged. As illustrated in FIG. 5, the piezoelectric element 37 is a laminated structure in which a piezoelectric layer 373 intervenes between an electrode 371 and an electrode 372. The piezoelectric element 37 is, for example, a section where the electrode 371, electrode 372, and piezoelectric layer 373 overlap in a plan view from the −Z direction.

As described above, the piezoelectric element 37 deforms in response to a driving signal Com supplied to it. The vibrating section 36 vibrates in synchronization with the deformation of the piezoelectric element 37. When the vibrating section 36 vibrates, the pressure in the pressure chamber varies. When the pressure in the pressure chamber vibrates, the ink in the pressure chamber passes through the flow path 324 and is charged from the nozzle N.

A combination of the pressure chamber, flow path 324, nozzle N, vibrating section 36, and piezoelectric element 37 functions as a discharging section that discharges the ink supplied in the pressure chamber. A combination of 2M discharging sections and the nozzle plate 52, which are provided in the head unit 26, will sometimes be referred to as the discharging head.

As illustrated in FIGS. 3 and 4, in the space inside the concave portion 82, the rigid wiring substrate 38 is disposed on the surface of the vibrating section 36 on the −Z side.

The rigid wiring substrate 38 is a plate-like member that is elongated in the Y-axis direction and extends in substantially parallel to an XY plane. The rigid wiring substrate 38 protects the 2M piezoelectric elements 37 formed on the vibrating section 36.

The rigid wiring substrate 38 is manufactured by, for example, using a semiconductor manufacturing technology to process a monocrystalline silicon substrate. In the manufacturing of the rigid wiring substrate 38, however, any known material and any known manufacturing method can be used.

As illustrated in FIG. 5, two concave portions 380 are formed in the surface of the rigid wiring substrate 38 on the +Z side. A space inside the concave portion 380, that is, a space between the rigid wiring substrate 38 and the vibrating section 36, will be referred to below as a sealing space 382. That is, in the head unit 26 in this embodiment, two sealing spaces 382 are provided between the rigid wiring substrate 38 and the vibrating section 36. One of the two sealing spaces 382 is a space that accommodates M piezoelectric elements 37 corresponding to M nozzles N1. The other of the two sealing spaces 382 is a space that accommodates M piezoelectric elements 37 corresponding to M nozzles N2. Each sealing space 382 seals the relevant piezoelectric elements 37 to protect their quality from being changed by being affected oxygen, moisture, or the like. That is, the rigid wiring substrate 38 functions as a protective member that protects the piezoelectric elements 37.

As illustrated in FIGS. 3 and 4, in the space inside the concave portion 82, the integrated circuit 62 including a switch circuit is disposed on the surface of the rigid wiring substrate 38 on the −Z side.

The switch circuit provided on the integrated circuit 62 makes a switchover under control of the control signal SI as to whether to supply a driving signal Com to each piezoelectric element 37. Although this embodiment assumes that the driving signal Com is created in the controller 20, the driving signal Com may be created in the integrated circuit 62.

As illustrated in FIGS. 4 and 5, in this embodiment, the integrated circuit 62 overlaps at least part of the 2M piezoelectric elements 37 disposed in the head unit 26 in a plan view from the Z-axis direction.

As illustrated in FIGS. 4 and 5, in this embodiment, a heat transfer agent 90 such as grease is applied to the surface of the integrated circuit 62 on the −Z side. The external case 80 is disposed so that the surface of the convex portion 810 on the +Z side comes into contact with the heat transfer agent 90. Specifically, the heat transfer agent 90 is applied so that the distance D1 between the convex portion 810 and the integrated circuit 62 is shorter than the distance D2 between the integrated circuit 62 and the piezoelectric element 37. In this embodiment, the thermal conductivity of the external case 80 is higher than the thermal conductivity of the rigid wiring substrate 38, piezoelectric element 37, and vibrating section 36 as described above.

In this embodiment, therefore, the amount of heat that is generated in the integrated circuit 62 and is dissipated from the integrated circuit 62 to the outside of the head unit 26 through the convex portion 810 and upper lid 820 is larger than the amount of heat that is generated in the integrated circuit 62 and is transmitted to the ink supplied in the pressure chamber from the integrated circuit 62 through all or part of the rigid wiring substrate 38, piezoelectric element 37, and vibrating section 36. That is, in this embodiment, since the head unit 26 includes the external case 80, it is possible to reduce the extent to which the temperature of the ink supplied in the pressure chamber is raised due to heat generated in the integrated circuit 62 when compared with, for example, a case in which the external case 80 is not provided.

In this embodiment, the side surface 801 and side surface 802 are fixed to the vibration absorbing body 54 as described above. Therefore, even when heat generated in the integrated circuit 62 is transferred to the ink in the pressure chamber, the heat transferred to the ink in the pressure chamber can be dissipated to the outside of the head unit 26 through the ink in the flow path 322, the ink in the flow path 326, the vibration absorbing body 54, and the side surface 801 or side surface 802. That is, in this embodiment, since the external case 80 is provided, it is possible to reduce the extent to which the temperature of the ink supplied in the pressure chamber is raised due to heat generated in the integrated circuit 62 when compared with, for example, a case in which the external case 80 is not provided.

As illustrated in FIG. 3, 2M wires 384 are formed on the surface of the rigid wiring substrate 38 on the −Z side in one-to-one correspondence with, for example, the 2M piezoelectric elements 37. Each wire 384 is electrically coupled to the integrated circuit 62. As illustrated in FIG. 5, each wire 384 is also electrically coupled to a coupling terminal 386 provided on the surface of the rigid wiring substrate 38 on the +Z side through a contact hole H that passes through the rigid wiring substrate 38. Then, the coupling terminal 386 is electrically coupled to the electrode 372 of the piezoelectric element 37. Therefore, a driving signal Com output from the integrated circuit 62 is supplied to the piezoelectric element 37 through the wire 384, contact hole H, and coupling terminal 386. The contact hole H is an example of a through-hole. The wire 384 is an example of a coupling wire.

As illustrated in FIG. 3, a plurality of wires 388 that are electrically coupled to the integrated circuit 62 are formed on the surface of the rigid wiring substrate 38 on the −Z side. The plurality of wires 388 extend to an area E at an end on the +Y side on the surface of the rigid wiring substrate 38 on the −Z side. A flexible wiring board 64 is joined to the area E on the surface of the rigid wiring substrate 38 on the −Z side. The flexible wiring board 64 is a component on which a plurality of wires are formed that electrically couple the plurality of wires 388 to the controller 20.

As illustrated in FIGS. 3 and 4, the holding chamber forming substrate 40 is disposed on the surface of the flow path substrate 32 on the −Z side in the space inside the concave portion 82.

The holding chamber forming substrate 40 is a member elongated in the Y-axis direction. The holding chamber forming substrate 40 includes a holding chamber RB1 that holds an ink to be supplied to the M pressure chambers corresponding to the M nozzles N1 through the flow path RA1, the holding chamber RB1 being a space elongated in the Y-axis direction. The holding chamber forming substrate 40 also includes a holding chamber RB2 that holds an ink to be supplied to the M pressure chambers corresponding to the M nozzles N2 through the flow path RA2, the holding chamber RB2 being a space elongated in the Y-axis direction. The holding chamber RB1 is an example of a first holding chamber, and the holding chamber RB2 is an example of a second holding chamber.

A concave portion 42 is formed in the surface of the holding chamber forming substrate 40 on the +Z side. The pressure chamber substrate 34, vibrating section 36, plurality of piezoelectric elements 37, rigid wiring substrate 38, and integrated circuit 62 are accommodated in a space inside the concave portion 42. Specifically, as seen from FIG. 4, the pressure chamber substrate 34, vibrating section 36, plurality of piezoelectric elements 37, rigid wiring substrate 38, and integrated circuit 62 are disposed in a space between the holding chamber RB1 and the holding chamber RB2.

The flexible wiring board 64 joined to the area E on the rigid wiring substrate 38 extends in the Y-axis direction so as to pass through the interior of the concave portion 42. As seen from FIG. 3, the width W1 of the flexible wiring board 64 in the X-axis direction is smaller than the width W2 of the holding chamber forming substrate 40 in the X-axis direction. The width W2 is smaller than the width W3 of the external case 80 in the X-axis direction.

A heat dissipation opening 48 is formed in the holding chamber forming substrate 40 so as to pass through the holding chamber forming substrate 40 in the Z-axis direction. In this embodiment, the convex portion 810 in the external case 80 is disposed so as to pass through the interior of the heat dissipation opening 48 in the space between the upper lid 820 and the heat transfer agent 90 applied to the +Z side of the integrated circuit 62. As seen from FIG. 4, at least part of the convex portion 810 is positioned in the space between the holding chamber RB1 and the holding chamber RB2.

In this embodiment, the holding chamber forming substrate 40 is formed from a material separate from the materials of the flow path substrate 32 and pressure chamber substrate 34. Specifically, the holding chamber forming substrate 40 is formed by, for example, being injection-molded with a resin material. In the manufacturing of the holding chamber forming substrate 40, however, any known material and any known manufacturing method can be used. Synthetic fiber such as poly-phenylene benzobisoxazole fiber or a resin material such as a liquid crystal polymer, for example, is preferable as the material of the holding chamber forming substrate 40.

An introduction port 831 and an introduction port 832 are formed in the external case 80. An introduction port 431 communicating with the introduction port 831 and holding chamber RB1 and an introduction port 432 communicating with the introduction port 832 and holding chamber RB2 are also formed in the holding chamber forming substrate 40. An ink is supplied from the liquid vessel 14 through the introduction port 831 and introduction port 431 to the holding chamber RB1. Similarly, an ink is supplied from the liquid vessel 14 through the introduction port 832 and introduction port 432 to the holding chamber RB2.

The ink supplied from the liquid vessel 14 to the introduction port 831 passes through the introduction port 431 and holding chamber RB1 and flows into the flow path RA1. Part of the ink that has flowed into the flow path RA1 is supplied to the pressure chamber corresponding to the nozzle N1 through the flow path 326 and flow path 322. The ink supplied to the pressure chamber corresponding to the nozzle N1 flows through the flow path 324 in the +Z direction and is discharged from the nozzle N1.

The ink supplied from the liquid vessel 14 to the introduction port 832 passes through the introduction port 432 and holding chamber RB2 and flows into the flow path RA2. Part of the ink that has flowed into the flow path RA2 is supplied to the pressure chamber corresponding to the nozzle N2 through the flow path 326 and flow path 322. The ink supplied to the pressure chamber corresponding to the nozzle N2 flows through the flow path 324 in the +Z direction and is discharged from the nozzle N2.

As illustrated in FIGS. 3 and 4, the vibration absorbing bodies 54 are disposed on the surface of the flow path substrate 32 on the +Z side to cover the flow path RA1, flow path RA2, two flow paths 326, and 2M flow paths 322. Each vibration absorbing body 54 is a compliance substrate that eliminates variations in the pressure of the ink in the flow path RA1 and holding chamber RB1 or the flow path RA2 and holding chamber RB2, whichever is applicable.

3. Effects of the Embodiment

As described above, since the head unit 26 according to this embodiment has the external case 80, it is possible to lower the possibility that the temperature of ink at the discharging section.

To clarify the advantages of the head unit 26 according to this embodiment, a head unit 26W provided in a head module 260W included in a liquid-discharging apparatus in a reference example will be described below.

Figure 6:
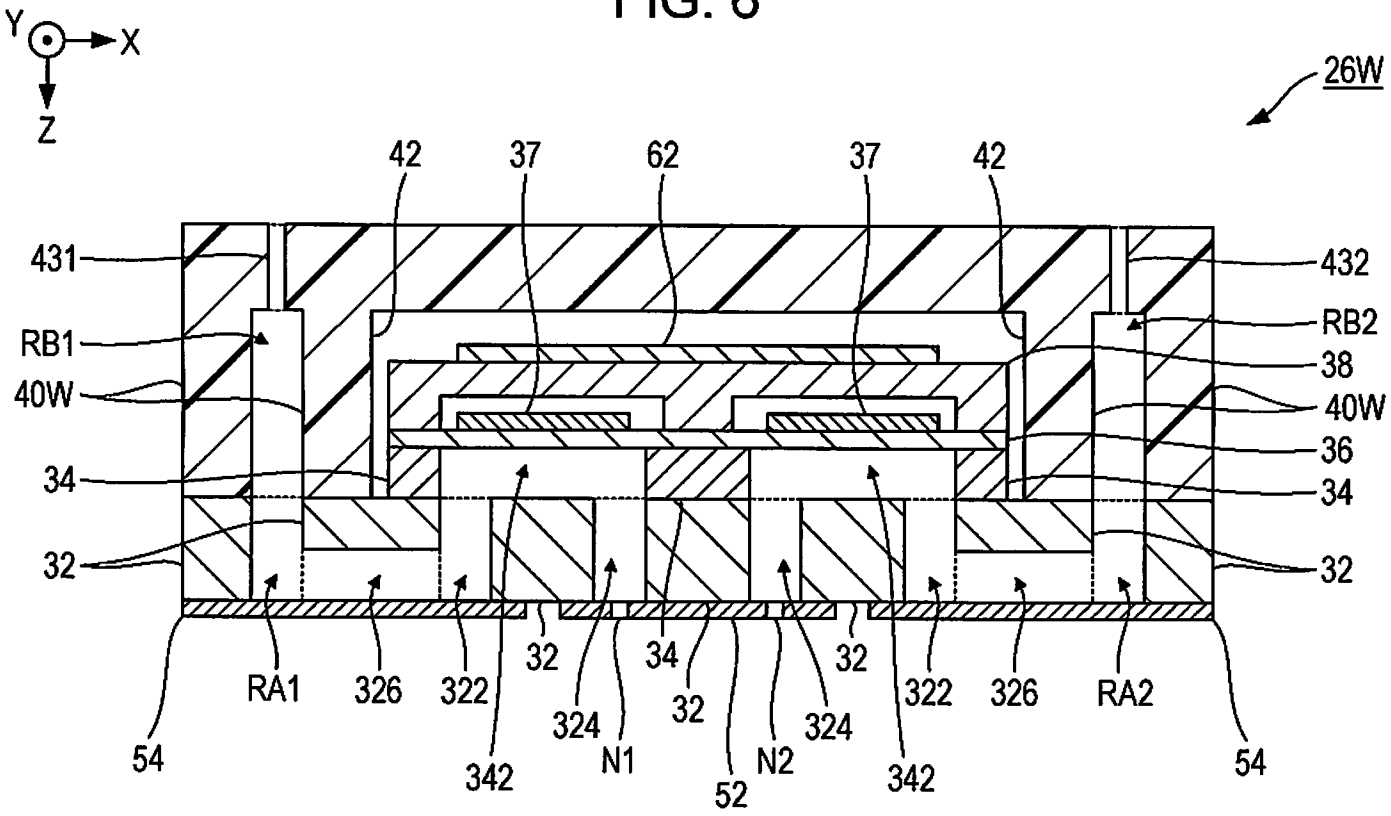
FIG. 6 is a cross-sectional view illustrating an example of the structure of a head unit in a reference example.

FIG. 6 is a cross-sectional view of the head unit 26W provided in the liquid-discharging apparatus in the reference example. The liquid-discharging apparatus in the reference example is structured as with the liquid-discharging apparatus 100 according to this embodiment, except that the liquid-discharging apparatus in the reference example has the head module 260W including head units 26W instead the head module 260 including head units 26.

As illustrated in FIG. 6, the head unit 26W differs from the head unit 26 in that the head unit 26W lacks the external case 80 and has a holding chamber forming substrate 40W instead of the holding chamber forming substrate 40. The holding chamber forming substrate 40W differs from the holding chamber forming substrate 40 provided in the head unit 26 according to this embodiment in that the holding chamber forming substrate 40W lacks the heat dissipation opening 48.

As described above, the head unit 26W lacks the external case 80 made of a material having thermal conductivity equal to higher than the prescribed thermal conductivity. In other words, all the constituent components of the head unit 26W are made of materials having thermal conductivity lower than the prescribed thermal conductivity. That is, the head unit 26W cannot efficiently dissipate heat generated in the integrated circuit 62 to the outside of the head unit 26W. In the head unit 26W, therefore, the ink supplied in the pressure chamber may become hot due to heat generated in the integrated circuit 62.

In contrast to this, the head unit 26 according to this embodiment has the external case 80 made of a material having thermal conductivity equal to higher than the prescribed thermal conductivity. In the head unit 26 according to this embodiment, the external case 80 is disposed so that the distance D1 between the external case 80 and the integrated circuit 62 is shorter than the distance D2 between the integrated circuit 62 and the piezoelectric element 37. Therefore, the amount of heat that the head unit 26 dissipates to the outside of the head unit 26, the heat being part of heat generated in the integrated circuit 62, is larger than the amount of heat that the head unit 26W dissipates to the outside of the head unit 26W, the heat being part of heat generated in the integrated circuit 62. Therefore, the amount of heat that the head unit 26 transfers from the integrated circuit 62 to the ink supplied in the pressure chamber is smaller than the amount of heat that the head unit 26W transfers from the integrated circuit 62 to the ink supplied in the pressure chamber. In other words, according to this embodiment, it is possible to reduce the extent to which the temperature of the ink supplied in the pressure chamber is raised due to heat generated in the integrated circuit 62 when compared with, for example, the reference example. Thus, according to this embodiment, it is possible to reduce the possibility that the quality of an image formed by the liquid-discharging apparatus 100 is lowered due to heat generated in the integrated circuit 62 when compared with, for example, the reference example.

Figure 7:
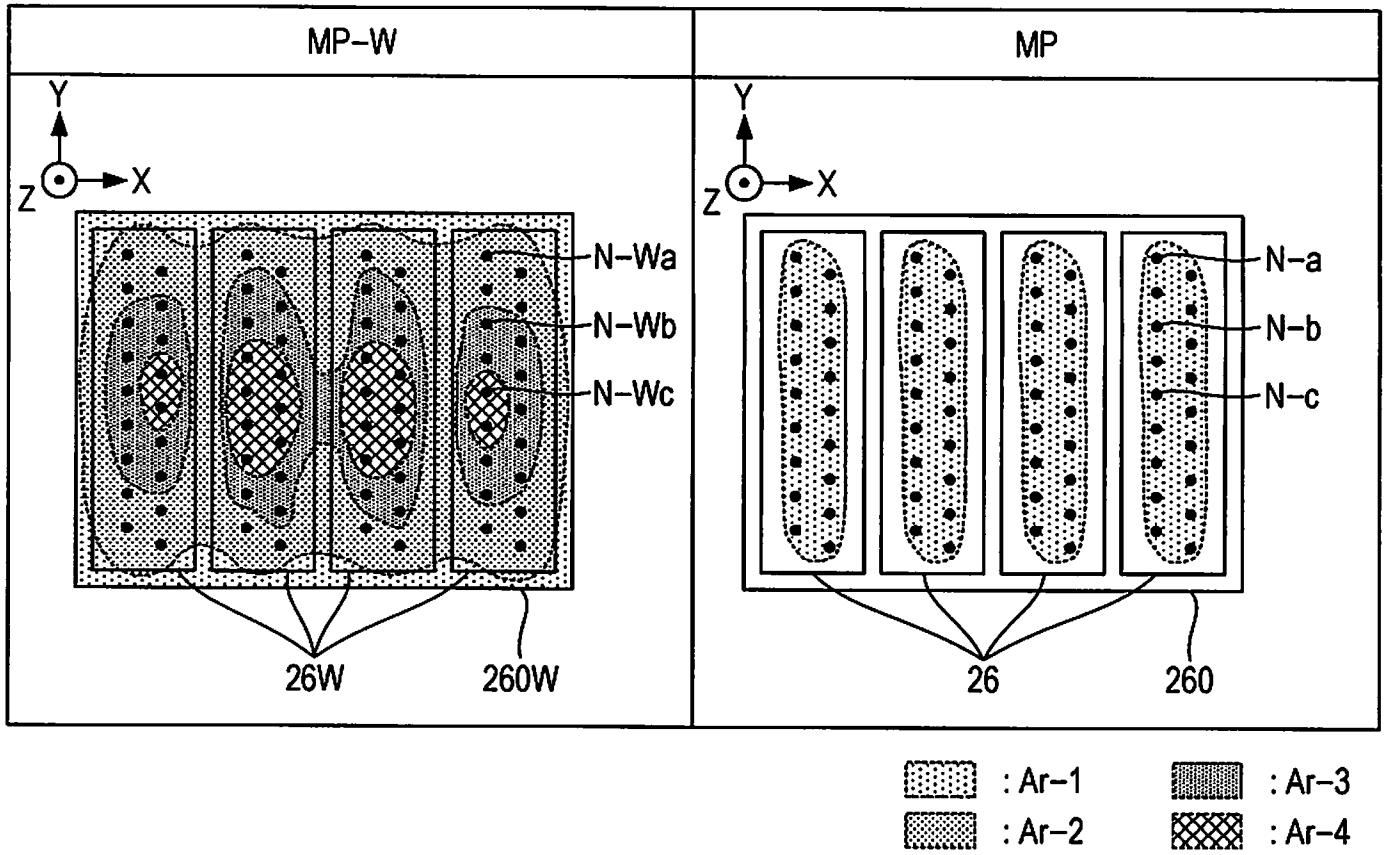
FIG. 7 illustrates an example of a temperature distribution in a head module according to an embodiment in the present disclosure.

FIG. 7 illustrates a temperature distribution map MP-W in the head module 260W when an ink is discharged from each nozzle N in the head module 260W placed in a prescribed environment a prescribed number of times at prescribed times, and also illustrates a temperature distribution map MP in the head module 260 when an ink is discharged from each nozzle N in the head module 260 placed in the prescribed environment the prescribed number of times at the prescribed times.

In FIG. 7, a dotted area Ar-1 is an area at temperatures of at least T0 and lower than T1, a dotted area Ar-2 is an area at temperatures of at least T1 and lower than T2, a dotted area Ar-3 is an area at temperatures of at least T2 and lower than T3, a hatched area Ar-4 is an area at temperatures of at least T3, and an area that is neither dotted nor hatched is an area at temperatures of lower than T0. Here, it will be assumed that when ΔT is positive, the following relationships hold in a temperature range of T0 to T3.

$$T3=T2+\Delta T$$

$$T2=T1+\Delta T$$

$$T1=T0+\Delta T$$

Since all the constituent components of the head unit 26W included in the liquid-discharging apparatus in the reference example are made of materials having thermal conductivity lower than the prescribed thermal conductivity as described above, the head unit 26W cannot efficiently dissipate heat generated in the integrated circuit 62. Therefore, a portion of the head unit 26W near its center is likely to become hotter than the edges of the head unit 26W in a plan view in the Z-axis direction. In particular, when 800 or more discharging sections are provided in the head unit 26W with a density of 400 or more discharging sections per inch, the possibility that the temperature of a portion of the head unit 26W near its center becomes higher than the temperature of the edges of the head unit 26W is increased.

Specifically, in the head unit 26W, a nozzle N-Wa is positioned in an area Ar-2, a nozzle N-Wb is positioned in an area Ar-3, and a nozzle N-Wc is positioned in an area Ar-4, the nozzles N-Wa, N-Wb, and N-Wc being included in the 2M nozzles N provided in the head unit 26W, as indicated in the temperature distribution map MP-W in FIG. 7. That is, in the head unit 26W, the temperature of the nozzle N-Wc positioned near the center of the head unit 26W is about 2×ΔT higher than the temperature of the nozzle N-Wa positioned at an edge of the head unit 26W. In the head unit 26W, therefore, the temperature of the ink supplied in the pressure chamber corresponding to the nozzle N-Wc is higher than the temperature of the ink supplied in the pressure chamber corresponding to the nozzle N-Wa. This causes the head unit 26W to have a difference in ink discharging property between the discharging section corresponding to the nozzle N-Wc and the discharging section corresponding to the nozzle N-Wa. Therefore, the quality of an image formed by the liquid-discharging apparatus in the reference example is lowered due to heat generated in the integrated circuit 62.

In contrast to this, since the head unit 26 provided in the liquid-discharging apparatus 100 according to this embodiment has the external case 80 made of a material having thermal conductivity equal to higher than the prescribed thermal conductivity, the head unit 26 can more efficiently dissipate heat generated in the integrated circuit 62 than the head unit 26W. Thus, even when 800 or more discharging sections are provided in this embodiment with a density of 400 or more discharging sections per inch, it is possible to reduce the temperature difference between a portion near the center of the head unit 26 and its edges below the temperature difference between a portion near the center of the head unit 26W and its edges.

Specifically, of the 2M nozzles N provided in the head unit 26, the nozzles N-a, N-b, and N-c are all positioned in the area Ar-1, as indicted by the temperature distribution map MP in FIG. 7. That is, with the head unit 26, it is possible to reduce the temperature difference between the nozzle N-c positioned near the center of the head unit 26 and the nozzle N-a positioned at an edge of the head unit 26 below ΔT. In other words, with the head unit 26, it is possible to reduce the temperature difference between the ink supplied in the pressure chamber corresponding to the nozzle N-c and the ink supplied in the pressure chamber corresponding to the nozzle N-a below the temperature difference between the ink supplied in the pressure chamber corresponding to the nozzle N-Wc and the ink supplied in the pressure chamber corresponding to the nozzle N-Wa. Therefore, with the head unit 26, it is possible to reduce the extent of the difference in ink discharging property between the discharging section corresponding to the nozzle N-c and the discharging section corresponding to the nozzle N-a below the extent of the difference in ink discharging property between the discharging section corresponding to the nozzle N-Wc and the discharging section corresponding to the nozzle N-Wa. Thus, with the liquid-discharging apparatus 100 according to this embodiment, it is possible to reduce the extent to which the quality of an image formed by the liquid-discharging apparatus 100 is lowered due to heat generated in the integrated circuit 62 when compared with the liquid-discharging apparatus in the reference example.

With the liquid-discharging apparatus 100 according to this embodiment, since the fan 250 is provided in the storage case 242, the temperature of the whole of the head unit 26 can be made lower than in, for example, an aspect in which the fan 250 is not provided in the storage case 242. Thus, with the liquid-discharging apparatus 100 according to this embodiment, it is possible to reduce the extent to which the quality of an image formed by the liquid-discharging apparatus 100 is lowered due to heat generated in the integrated circuit 62 when compared with an aspect in which the fan 250 is not provided in the storage case 242.

In this embodiment, one nozzle N of the M nozzles N arranged in the Y-axis direction is an example of a first nozzle, and each of the other nozzles N is an example of a second nozzle. In this embodiment, a pressure chamber disposed in correspondence with the first nozzle is an example of a first pressure chamber, and a pressure chamber disposed in correspondence with the second nozzle is an example of a second pressure chamber. In this embodiment, the piezoelectric element 37 disposed in correspondence with the first nozzle is an example of a first piezoelectric element, and the piezoelectric element 37 disposed in correspondence with the second nozzle is an example of a second piezoelectric element. In this embodiment, a common flow path is a general name for the flow path RA1 and flow path RA2.

B. Variations

The embodiment exemplified above can be varied in various ways. Aspects of specific variations will be exemplified below. Two or more aspects arbitrarily selected from examples below can be combined within a range in which any mutual contradiction does not occur.

First Variation

Although, in the embodiment described above, the external case 80 provided in the head unit 26 has the convex portion 810, the present disclosure is not limited to this aspect. The external case 80 may be structured without the convex portion 810.

Figure 8:
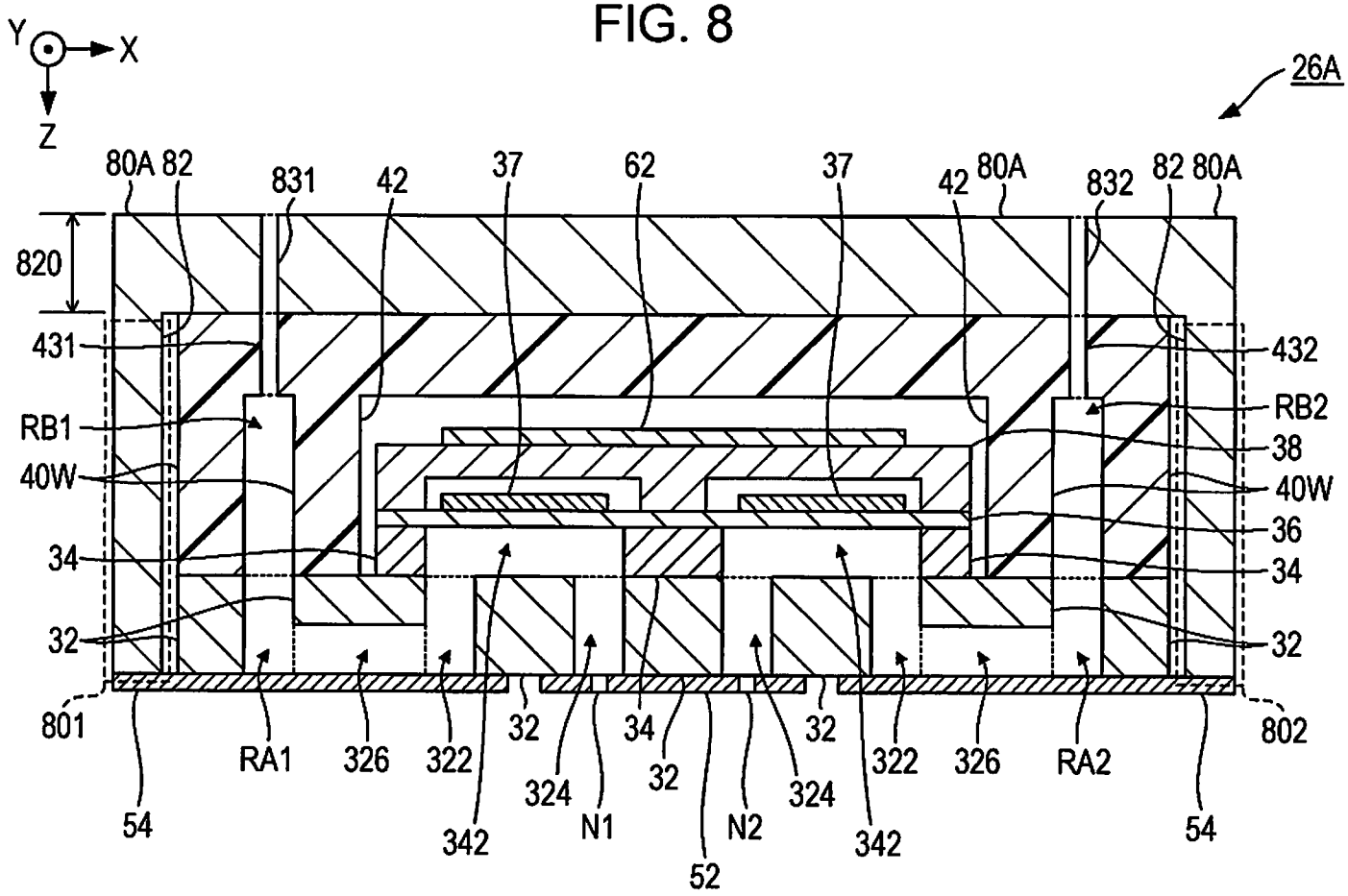
FIG. 8 is a cross-sectional view illustrating an example of the structure of a head unit according to a first variation.

FIG. 8 is a cross-sectional view of a head unit 26A provided in a liquid-discharging apparatus according to this variation. The liquid-discharging apparatus in this variation is structured as with the liquid-discharging apparatus 100 according to the above embodiment, except that the liquid-discharging apparatus in this variation has a head module 260A including head units 26A instead the head module 260 including head units 26.

As illustrated in FIG. 8, the head unit 26A differs from the head unit 26 according to the above embodiment in that the head unit 26A has an external case 80A instead of the external case 80 and has a holding chamber forming substrate 40W instead of the holding chamber forming substrate 40. The external case 80A differs from the external case 80 according to the above embodiment in that the external case 80A lacks the convex portion 810.

In the head unit 26A, the side surface 801 and side surface 802 of the external case 80A are fixed to the vibration absorbing body 54. In this variation, therefore, even when heat generated in the integrated circuit 62 is transferred to the ink supplied in the pressure chamber, the heat transferred to the ink supplied in the pressure chamber can be dissipated to the outside of the head unit 26A through the ink in the flow paths 322 and flow paths 326, the vibration absorbing body 54, and the side surface 801 or side surface 802.

Figure 9:
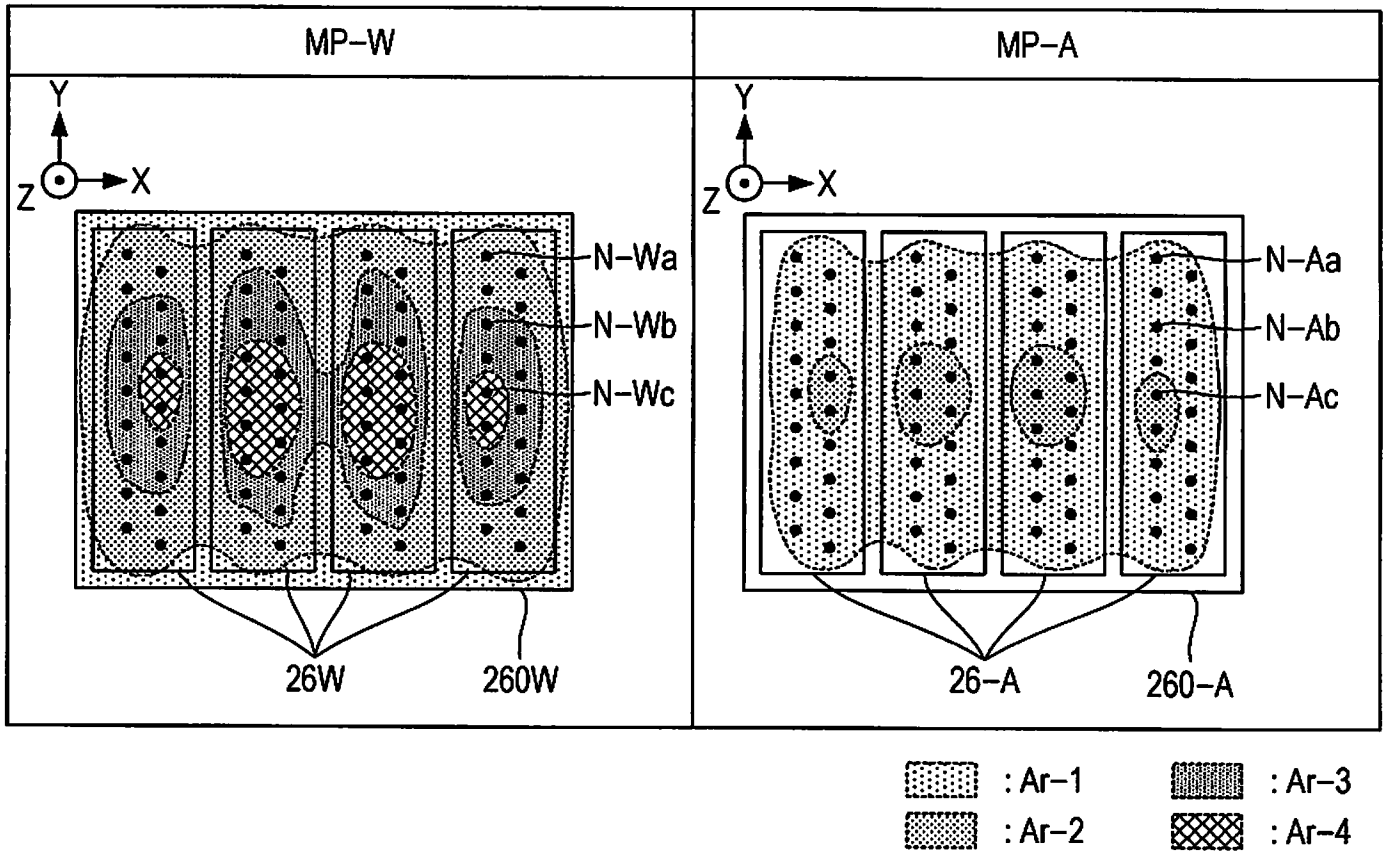
FIG. 9 illustrates an example of a temperature distribution in a head module according to the first variation.

FIG. 9 illustrates the temperature distribution map MP-W and a temperature distribution map MP-A in the head module 260A when an ink is discharged from each nozzle N in the head module 260A placed in the prescribed environment the prescribed number of times at the prescribed times.

In the head unit 26A, a nozzle N-Aa and a nozzle N-Ab are positioned in the area Ar-1, and a nozzle N-Ac is positioned in an area Ar-2, the nozzles N-Aa, N-Ab, and N-Ac being included in the 2M nozzles N provided in the head unit 26A, as indicated in the temperature distribution map MP-A in FIG. 9. That is, in the head unit 26A, the temperature difference between the nozzle N-Ac positioned near the center of the head unit 26A and the nozzle N-Aa positioned at an edge of the head unit 26A can be suppressed to about ΔT. In other words, with the head unit 26A, it is possible to reduce the temperature difference between the ink supplied in the pressure chamber corresponding to the nozzle N-Ac and the ink supplied in the pressure chamber corresponding to the nozzle N-Aa below the temperature difference between the ink supplied in the pressure chamber corresponding to the nozzle N-Wc and the ink supplied in the pressure chamber corresponding to the nozzle N-Wa. Therefore, with the head unit 26A, it is possible to reduce the extent of the difference in ink discharging property between the discharging section corresponding to the nozzle N-Ac and the discharging section corresponding to the nozzle N-Aa below the extent of the difference in ink discharging property between the discharging section corresponding to the nozzle N-Wc and the discharging section corresponding to the nozzle N-Wa. Thus, with the liquid-discharging apparatus according to this variation, it is possible to reduce the extent to which the quality of an image formed by the liquid-discharging apparatus according to this variation is lowered due to heat generated in the integrated circuit 62 when compared with the liquid-discharging apparatus in the reference example.

Second Variation

Although, in the embodiment described above, the external case 80 provided in the head unit 26 has the convex portion 810, the side surface 801, and side surface 802, the present disclosure is not limited to this aspect. The external case 80 may be structured without the convex portion 810, the side surface 801, and side surface 802.

Figure 10:
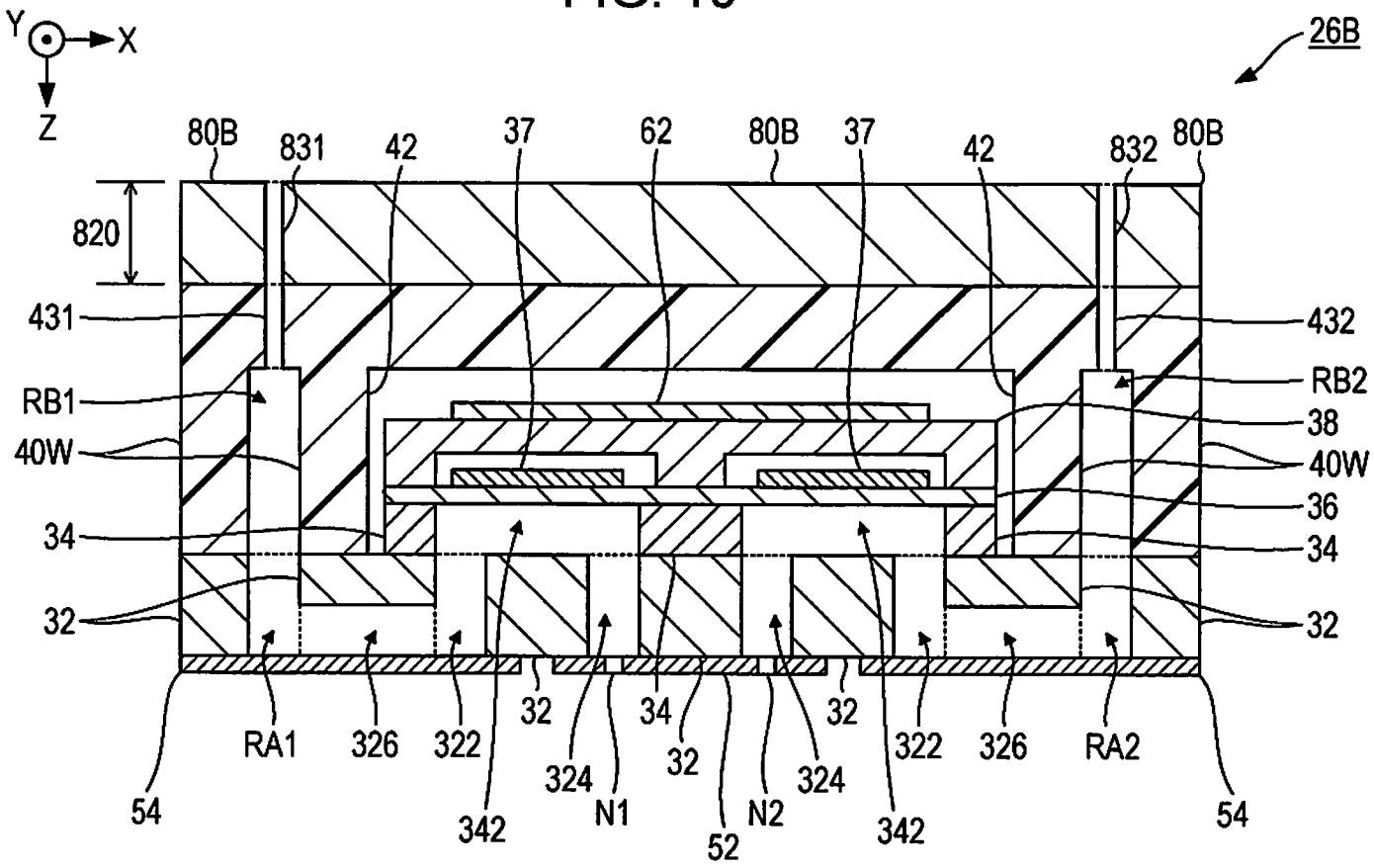
FIG. 10 is a cross-sectional view illustrating an example of the structure of a head unit according to a second variation.

FIG. 10 is a cross-sectional view of a head unit 26B provided in a liquid-discharging apparatus according to this variation. The liquid-discharging apparatus in this variation is structured as with the liquid-discharging apparatus 100 according to the above embodiment, except that the liquid-discharging apparatus in this variation has a head module 260B including head units 26B instead the head module 260 including head units 26.

As illustrated in FIG. 10, the head unit 26B differs from the head unit 26 according to the above embodiment in that the head unit 26B has an external case 80B instead of the external case 80 and has the holding chamber forming substrate 40W instead of the holding chamber forming substrate 40. The external case 80B differs from the external case 80 according to the above embodiment in that the external case 80B lacks the convex portion 810, side surface 801, and side surface 802.

In the head unit 26B, the upper lid 820 of the external case 80B is fixed to the holding chamber forming substrate 40W. In this variation, therefore, even when heat is generated in the integrated circuit 62, the heat can be dissipated to the outside of the head unit 26B through the rigid wiring substrate 38, vibrating section 36, pressure chamber substrate 34, and holding chamber forming substrate 40W.

Figure 11:
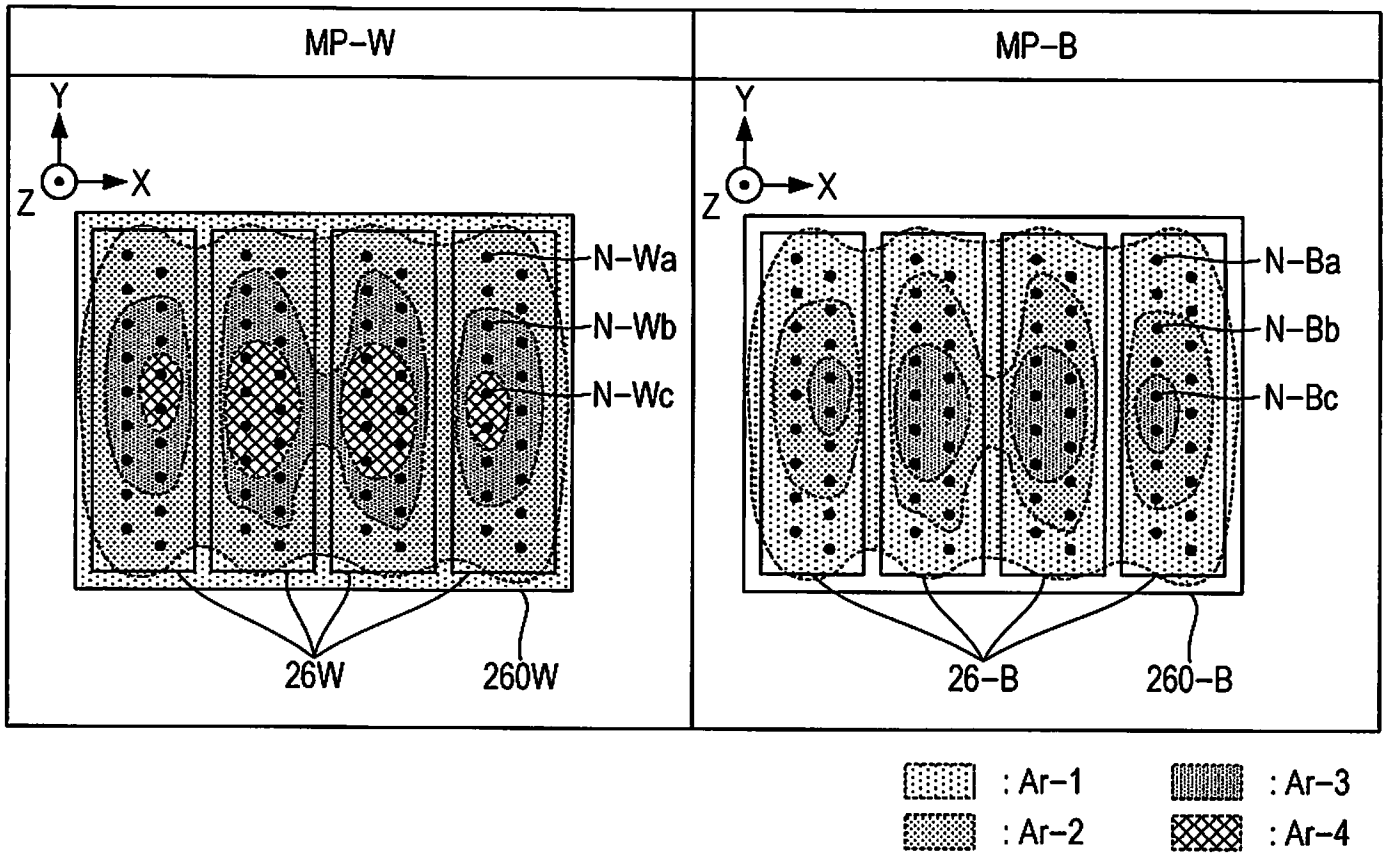
FIG. 11 illustrates an example of a temperature distribution in a head module according to the second variation.

FIG. 11 illustrates the temperature distribution map MP-W and a temperature distribution map MP-B in the head module 260B when an ink is discharged from each nozzle N in the head module 260B placed in the prescribed environment the prescribed number of times at the prescribed times.

In the head unit 26B, a nozzle N-Ba is positioned in the area Ar-1, a nozzle N-Bb is positioned in the area Ar-2, and a nozzle N-Bc is positioned in the area Ar-3, the nozzles N-Ba, N-Bb, and N-Bc being included in the 2M nozzles N provided in the head unit 26B, as indicated in the temperature distribution map MP-B in FIG. 11. That is, in the head unit 26B, the temperature of each nozzle N can be made lower than in the head unit 26W. Thus, with the liquid-discharging apparatus according to this variation, it is possible to reduce the extent to which the quality of an image formed by the liquid-discharging apparatus according to this variation is lowered due to heat generated in the integrated circuit 62 when compared with the liquid-discharging apparatus in the reference example.

Third Variation

Although, a case in which the head unit 26 included in the liquid-discharging apparatus 100 has the heat transfer agent 90 has been described in the above embodiment, the present disclosure is not limited to this aspect. The liquid-discharging apparatus 100 may be structured without the heat transfer agent 90.

Figure 12:
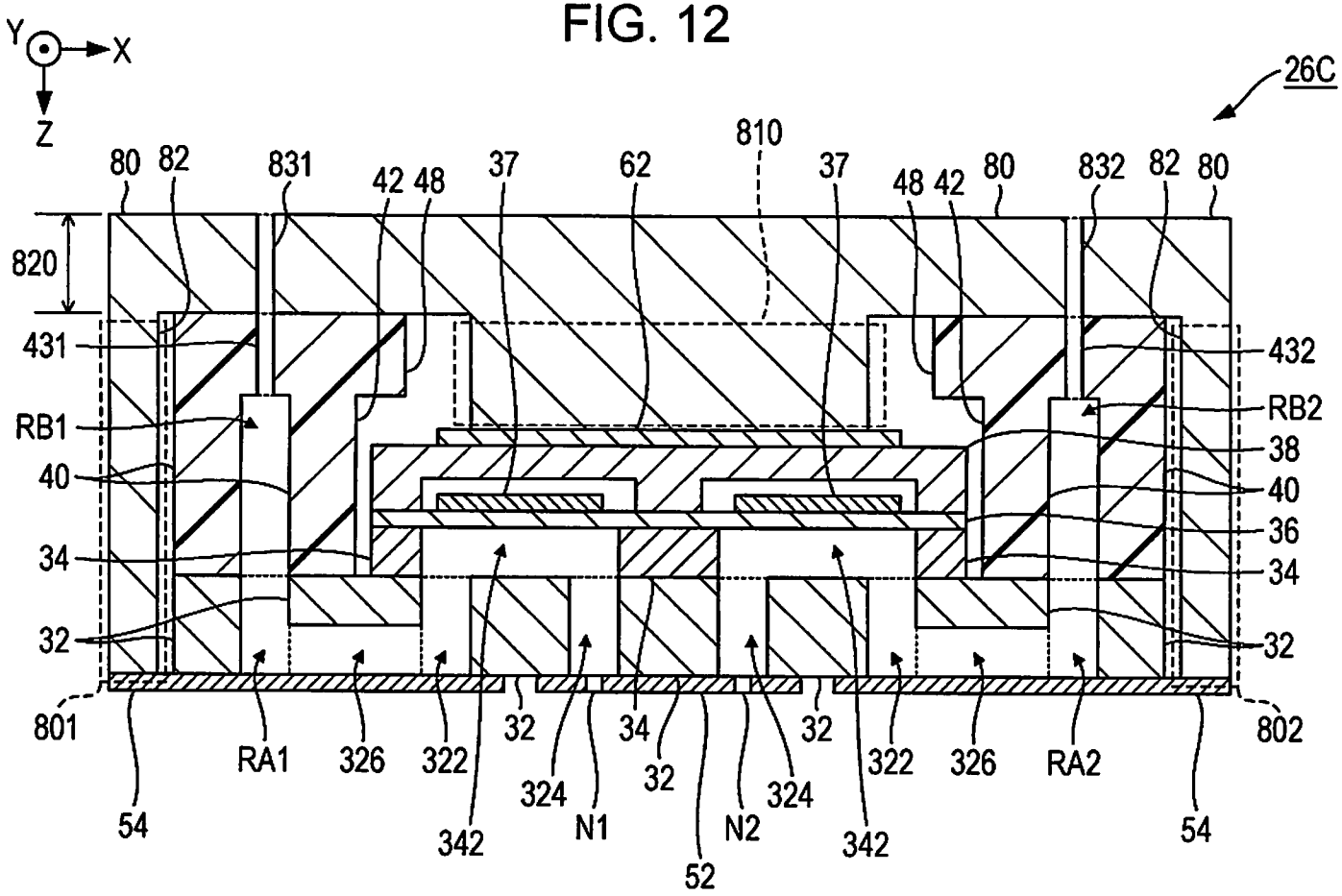
FIG. 12 is a cross-sectional view illustrating an example of the structure of a head unit according to a third variation.

FIG. 12 illustrates an example of the structure of a head unit 26C. The head unit 26C is structured as with the head unit 26 according to the above embodiment, except that the head unit 26C lacks the heat transfer agent 90. In the head unit 26C, the external case 80 is disposed so that the convex portion 810 provided in the external case 80 comes into contact with the integrated circuit 62. In this variation, it is assumed that the surface of the integrated circuit 62 on the −Z side is formed from a nonconductive material.

Fourth Variation

Although, in the embodiment and first to third variations described above, a serial liquid-discharging apparatus in which the storage case 242 in which head units are mounted is reciprocated has been exemplified, the present disclosure is not limited to this aspect. The liquid-discharging apparatus may be a line liquid-discharging apparatus in which a plurality of nozzles N are distributed across the width of the medium 12.

Figure 13:
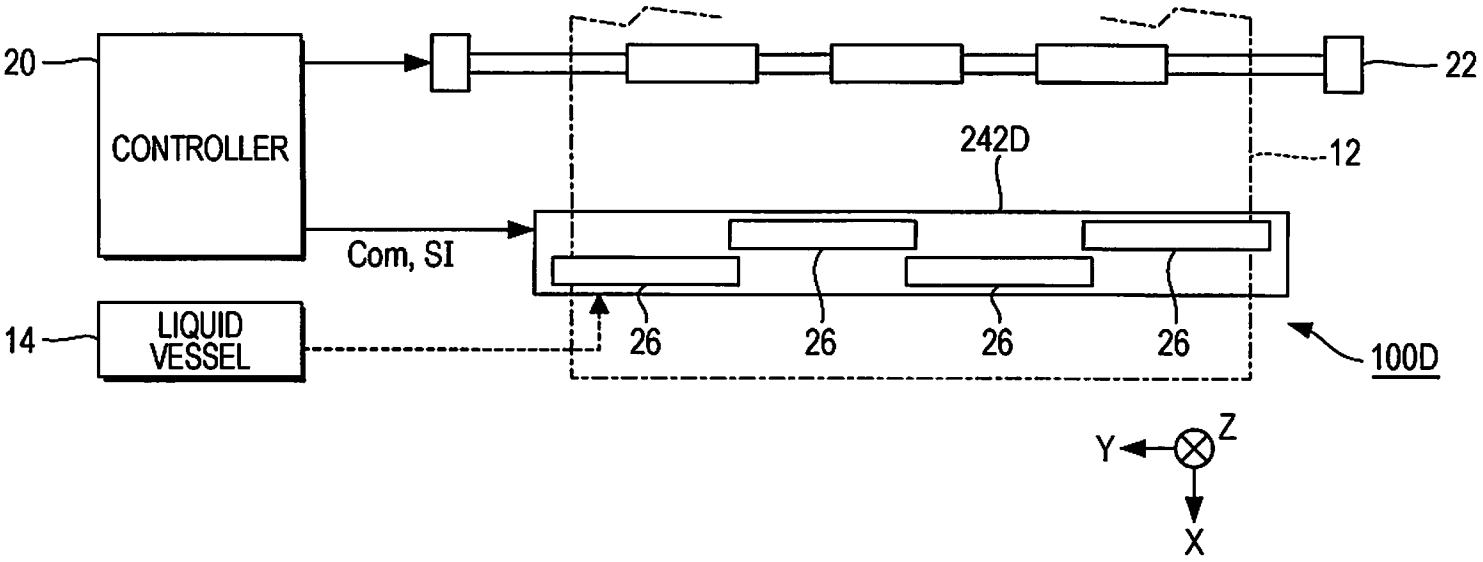
FIG. 13 illustrates the structure of an example of a liquid-discharging apparatus according to a fourth variation.

FIG. 13 illustrates an example of the structure of a liquid-discharging apparatus 100D. The liquid-discharging apparatus 100D has the liquid vessel 14, the controller 20, the transport mechanism 22, a plurality of head units 26, and a storage case 242D that accommodates the plurality of head units 26. That is, the liquid-discharging apparatus 100D according to this variation has a structure similar to the structure of the liquid-discharging apparatus 100 illustrated in FIG. 1, except that the liquid-discharging apparatus 100D lacks the endless belt 244 and has the storage case 242D instead of the storage case 242. The transport mechanism 22 in the liquid-discharging apparatus 100D transports the medium 12 in the +X direction. In the liquid-discharging apparatus 100D, a plurality of head units 26, the longitudinal direction of which is the Y-axis direction, are disposed in the storage case 242D so as to be distributed across the width of the medium 12. In the storage case 242D, head units 26A, head units 26B, or head units 26C may be mounted instead of head units 26.

Fifth Variation

In the embodiment and first to fourth variations described above, structures in which an ink exits from an pressure chamber and enters the flow path 324, after which the ink is discharged from the nozzle N corresponding to the pressure chamber have been exemplified for the head units 26, 26A, and 26C. However, the present disclosure is not limited to this aspect. The liquid-discharging apparatus may have a structure in which part or all of the ink in a pressure chamber can be exhausted from other than the nozzle N corresponding to the pressure chamber.

Figure 14:
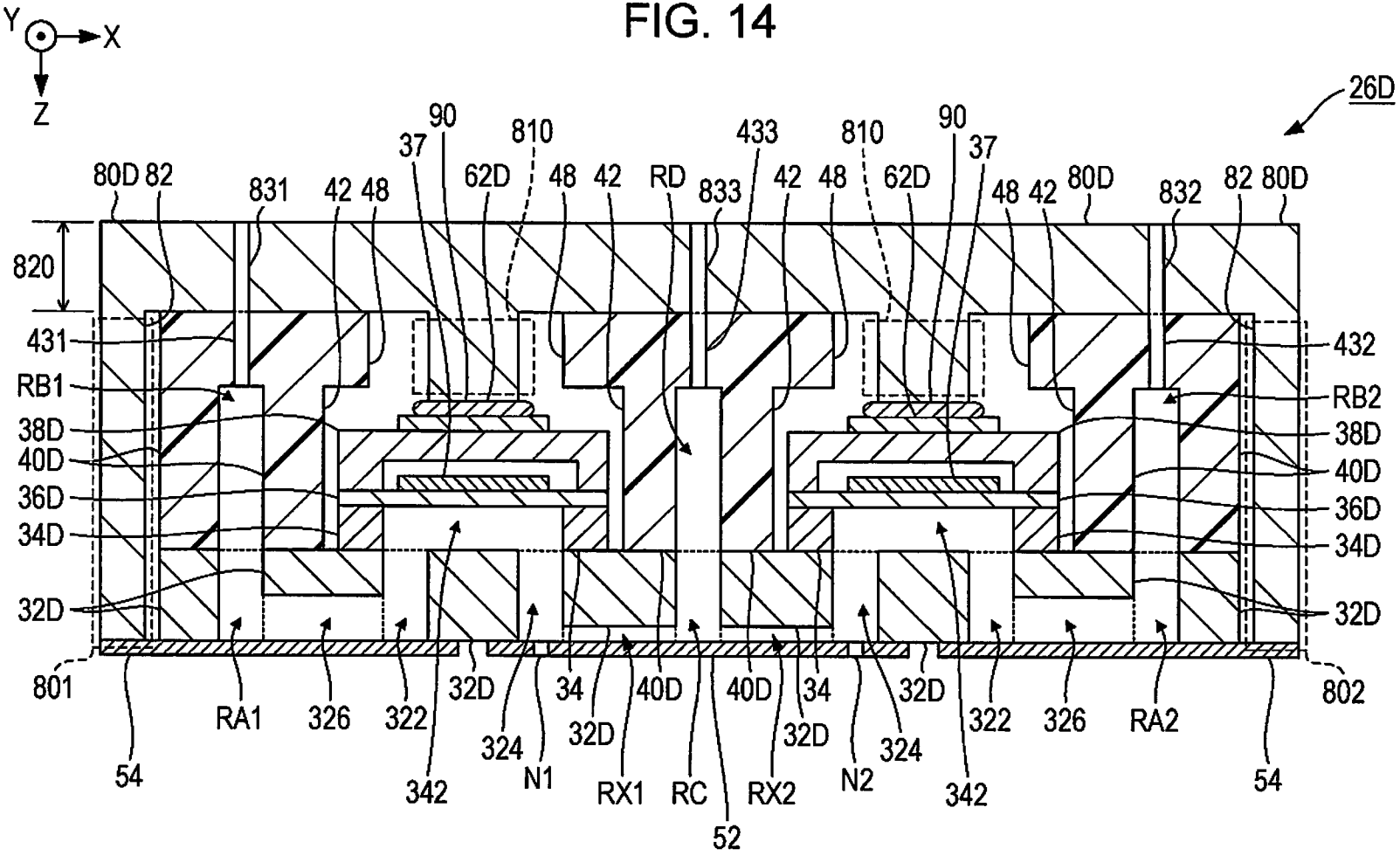
FIG. 14 is a cross-sectional view illustrating an example of the structure of a head unit according to a fifth variation.

FIG. 14 illustrates an example of the structure of a head unit provided in a liquid-discharging apparatus according to this variation. As illustrated in FIG. 14, the head unit 26D according to this variation differs from the head unit 26 in the above embodiment in that the head unit 26D has a flow path substrate 32D instead of the flow path substrate 32, two pressure chamber substrates 34D instead of the pressure chamber substrate 34, two vibrating sections 36D instead of the vibrating section 36, two rigid wiring substrates 38D instead of the rigid wiring substrate 38, a holding chamber forming substrate 40D instead of the holding chamber forming substrate 40, two integrated circuits 62D instead of the integrated circuit 62, and an external case 80D instead of the external case 80.

The flow path substrate 32D differs from the flow path substrate 32 in the above embodiment in that the flow path substrate 32D is a member that is elongated in the Y-axis direction and has M flow paths RX1 in one-to-one correspondence with the M nozzles N1, M flow paths RX2 in one-to-one correspondence with the M nozzles N2, and one flow path RC elongated in the Y-axis direction. The flow path RX1 provided in correspondence with one nozzle N1 links the flow path 324 corresponding to the one nozzle N1 and the flow path RC together. The flow path RX2 provided in correspondence with one nozzle N2 links the flow path 324 corresponding to the one nozzle N2 and the flow path RC together. The flow path RX1, flow path RX2, and flow path RC are each an example of an exhausting flow path.

The holding chamber forming substrate 40D differs from the holding chamber forming substrate 40 in the above embodiment in that the holding chamber forming substrate 40D is a member that is elongated in the Y-axis direction and has two heat dissipation openings 48, one of which corresponds to the row L1 and the other of which corresponds to the row L2, instead of one heat dissipation opening 48, one flow path RD elongated in the Y-axis direction is provided, the flow path RD communicating with the flow path RC, and an introduction port 433 communicating with the flow path RD is provided. The flow path RD is an example of an exhausting chamber.

One of the two pressure chamber substrates 34D provided in the head unit 26D is a pressure chamber substrate 34D that is elongated in the Y-axis direction and has M openings 342 corresponding to the M nozzles N1, and the other is a pressure chamber substrate 34D that is elongated in the Y-axis direction and has M openings 342 corresponding to the M nozzles N2. That is, each pressure chamber substrate 34D differs from the pressure chamber substrate 34 in the above embodiment in that, of the 2M pressure chambers provided in the head unit, only the M pressure chambers corresponding to either the row L1 or row L2, whichever is applicable, are formed.

One of the two vibrating sections 36D provided in the head unit 26D is a vibrating section 36D that is elongated in the Y-axis direction and constitutes the wall surfaces of the M openings 342 corresponding to the M nozzles N1, and the other is a vibrating section 36D that is elongated in the Y-axis direction and constitutes the wall surfaces of the M openings 342 corresponding to the M nozzles N2. That is, each vibrating section 36D differs from the vibrating section 36 in the above embodiment in that the vibrating section 36D forms the wall surfaces of only the M pressure chambers, included in the 2M pressure chambers provided in the head unit, that correspond to the row L1 or row L2, whichever is applicable.

One of the two rigid wiring substrates 38D provided in the head unit 26D is a rigid wiring substrate 38D that is elongated in the Y-axis direction and protects the M piezoelectric elements 37 corresponding to the M nozzles N1, and the other is a rigid wiring substrate 38D that is elongated in the Y-axis direction and protects the M piezoelectric elements 37 corresponding to the M nozzles N2. That is, each rigid wiring substrate 38D differs from the rigid wiring substrate 38 in the above embodiment in that the rigid wiring substrate 38D can accommodate only the M piezoelectric elements 37, included in the 2M piezoelectric elements 37 provided in the head unit, that correspond to either the row L1 or row L2, whichever is applicable.

One of the two integrated circuits 62D provided in the head unit 26D is an integrated circuit 62D that supplies a driving signal Com to the M piezoelectric elements 37 corresponding to the M nozzles N1, and the other is an integrated circuit 62D that supplies a driving signal Com to the M piezoelectric elements 37 corresponding to the M nozzles N2. That is, each integrated circuit 62D differs from the integrated circuit 62 in the above embodiment in that the integrated circuit 62D can supply a driving signal Com only to the M piezoelectric elements 37, included in the 2M piezoelectric elements 37 provided in the head unit, that correspond to either the row L1 or row L2, whichever is applicable.

The external case 80D differs from the external case 80 in the above embodiment in that the external case 80D is a member that is elongated in the Y-axis direction and has two convex portions 810, one of which corresponds to the row L1 and the other of which corresponds to the row L2, instead of one convex portion 810, and an introduction port 833 communicating with the introduction port 433 is provided.

In the head unit 26D illustrated in FIG. 14, the ink that has flowed out of the holding chamber RB1 passes through the flow path RA1, flow path 326 and flow path 322, and flows into the pressure chamber corresponding to the nozzle N1, after which when the piezoelectric element 37 corresponding to the pressure chamber is driven, the ink flows into the flow path 324 corresponding to the nozzle N1. One part of the ink that has flowed into the flow path 324 corresponding to the nozzle N1 is discharged from the nozzle N1. Another part of the ink that has flowed into the flow path 324 corresponding to the nozzle N1 passes through the flow path RX1 and is then exhausted into the flow path RC. In the head unit 26D, the ink that has flowed out of the holding chamber RB2 passes through the flow path RA2, flow path 326 and flow path 322, and flows into the pressure chamber corresponding to the nozzle N2, after which when the piezoelectric element 37 corresponding to the pressure chamber is driven, the ink flows into the flow path 324 corresponding to the nozzle N2. One part of the ink that has flowed into the flow path 324 corresponding to the nozzle N2 is discharged from the nozzle N2. Another part of the ink that has flowed into the flow path 324 corresponding to the nozzle N2 passes through the flow paths RX2 and is then exhausted into the flow path RC. The ink exhausted into the flow path RC further passes through the flow path RD and introduction port 833 and is then exhausted to the outside of the head unit 26D.

As described above, in the head unit 26D, the ink in the pressure chamber not only can be discharged from the nozzle N but also can be exhausted from the flow path RC and flow path RD to the outside of the head unit 26D through the flow path RX1 or flow path RX2. Thus, with the head unit 26D, it is possible to activate the circulation of the ink in the pressure chamber when compared with an aspect in which the neither flow path RC nor the flow path RD is provided in the head unit. This makes it possible to lower the possibility that the ink in the pressure chamber becomes more viscous and to lower the possibility that the ink in the pressure chamber becomes hotter.

In the head unit 26D, the ink that has been exhausted from the introduction port 833 to the outside of the head unit 26D may be introduced into the head unit 26D again from the introduction port 831 and introduction port 832.

Figure 15:
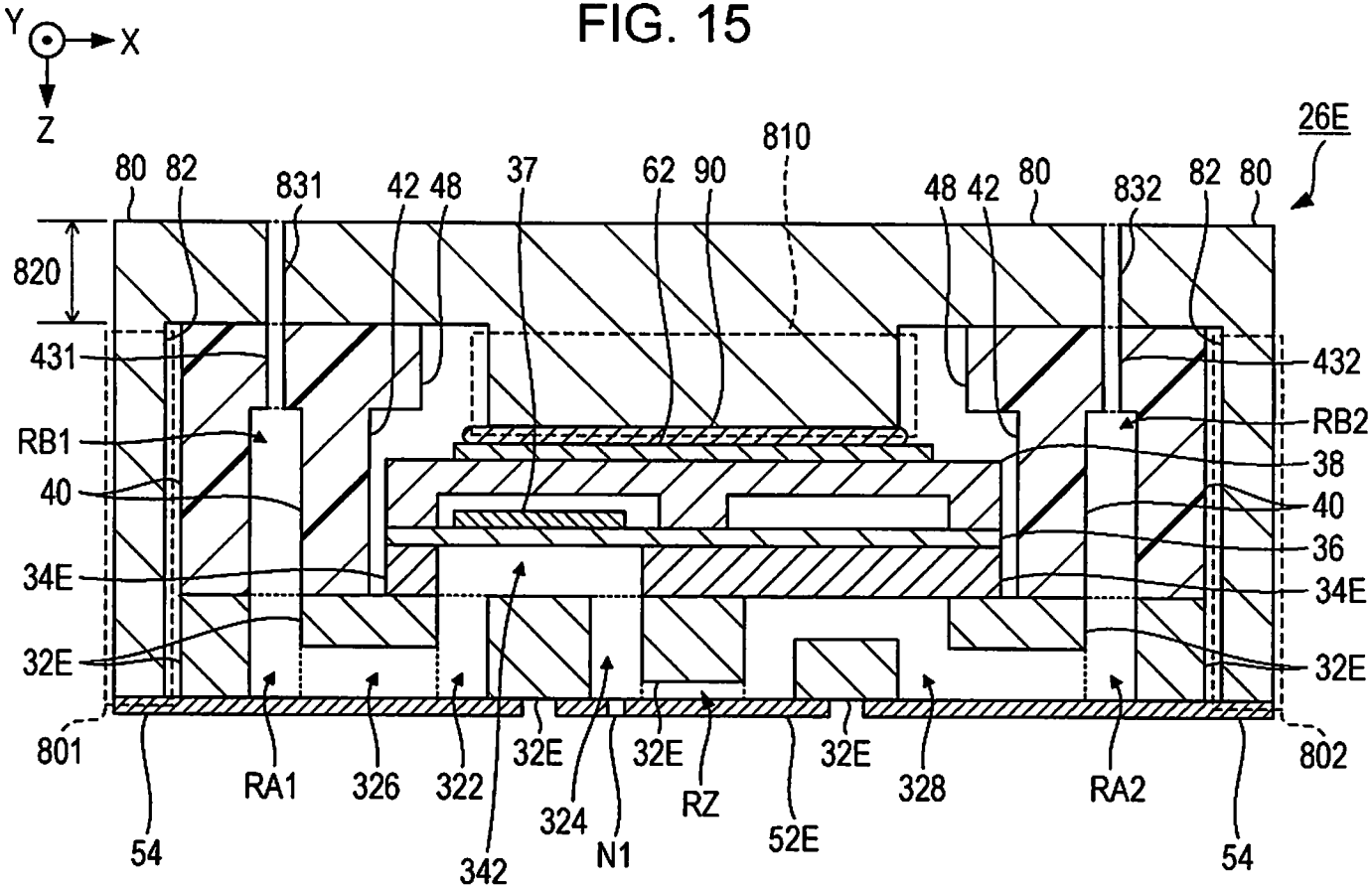
FIG. 15 is a cross-sectional view illustrating an example of the structure of another head unit according to the fifth variation.

FIG. 15 illustrates an example of the structure of another head unit provided in a liquid-discharging apparatus according to this variation. As illustrated in FIG. 15, the head unit 26E according to this variation differs from the head unit 26 in the above embodiment in that the head unit 26E has a flow path substrate 32E instead of the flow path substrate 32, a pressure chamber substrate 34E instead of the pressure chamber substrate 34, a nozzle plate 52E instead of the nozzle plate 52, only the M nozzles N1 corresponding to the row L1 instead of the 2M nozzles N, only the M piezoelectric elements 37 corresponding to the M nozzles N1 instead of the 2M piezoelectric elements 37, and only the M pressure chambers corresponding to the M nozzles N1 instead of the 2M pressure chambers.

The flow path substrate 32E differs from the flow path substrate 32 in the above embodiment in that the flow path substrate 32E is a member that is elongated in the Y-axis direction and has M flow paths RZ in one-to-one correspondence with the M nozzles N1 and M flow paths 328 in one-to-one correspondence with the M nozzles N1. The flow path RZ provided in correspondence with one nozzle N1 links the flow path 324 corresponding to the one nozzle N1 and the flow path 328 corresponding to the one nozzle N1 together. The flow path 328 provided in correspondence with one nozzle N1 links the flow path RZ corresponding to the one nozzle N1 and the RA2 together.

The pressure chamber substrate 34E differs from the pressure chamber substrate 34 in the above embodiment in that the pressure chamber substrate 34E is a member that is elongated in the Y-axis direction and has only the M pressure chambers corresponding to the row L1 instead of the 2M pressure chambers.

The nozzle plate 52E differs from the nozzle plate 52 in the above embodiment in that the nozzle plate 52E is a member that is elongated in the Y-axis direction and has only the M nozzles N1 corresponding to the row L1 instead of the 2M nozzles N.

In the head unit 26E illustrated in FIG. 15, the ink that has flowed out of the holding chamber RB1 passes through the flow path RA1, flow path 326 and flow path 322, and flows into the pressure chamber corresponding to the nozzle N1, after which when the piezoelectric element 37 corresponding to the pressure chamber is driven, the ink flows into the flow path 324 corresponding to the nozzle N1. Part of the ink that has flowed into the flow path 324 corresponding to the nozzle N1 is discharged from the nozzle N1. Another part of ink that has flowed into the flow path 324 corresponding to the nozzle N1 passes through the flow path RZ, flow path 328, flow path RA2, holding chamber RB2, and introduction port 832, and is then exhausted to the outside of the head unit 26E.

As described above, in the head unit 26E, the ink in the pressure chamber not only can be discharged from the nozzle N but also can be exhausted from the introduction port 832 to the outside of the head unit 26E through the flow path RZ and flow path 328. Thus, with the head unit 26E, it is possible to activate the circulation of the ink in the pressure chamber when compared with an aspect in which the neither flow path RZ nor the flow path 328 is provided in the head unit. This makes it possible to lower the possibility that the ink in the pressure chamber becomes more viscous and to lower the possibility that the ink in the pressure chamber becomes hotter.

In the head unit 26E, the ink that has been exhausted from the introduction port 832 to the outside of the head unit 26E may be introduced into the head unit 26E again from the introduction port 831.

Sixth Variation

In this variation, the sealing space 382, in the embodiment and the first to fifth variations described above, between the vibrating section 36 or vibrating section 36D and the rigid wiring substrate 38 or rigid wiring substrate 38D will be described in detail.

Figure 16:
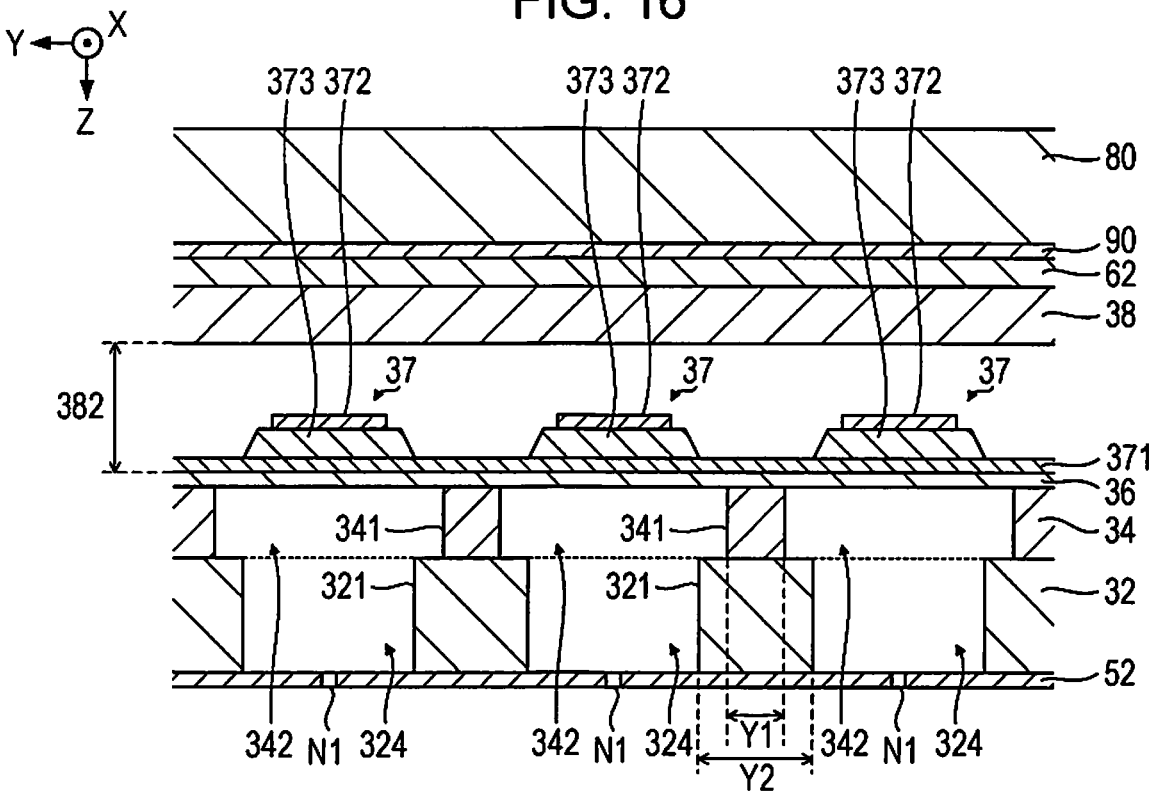
FIG. 16 is a cross-sectional view illustrating an example of a sealed space according to a sixth variation.

FIG. 16 illustrates an example of the sectional structure of the head unit 26 when the head unit 26 is cut along line XVI-XVI in FIG. 4. Although, in this variation, the sectional structure of the head unit 26 will be exemplified, the description in this variation similarly applies to the head units 26A, 26B, 26C, 26D, and 26E as well.

In the flow path substrate 32, a wall 321 is formed between the flow path 324 corresponding to one nozzle N and the flow path 324 corresponding to another nozzle N adjacent to the one nozzle N in the Y-axis direction, as illustrated in FIG. 16. In the pressure chamber substrate 34, a wall 341 is formed between the opening 342 corresponding to one nozzle N and the opening 342 corresponding to another nozzle N adjacent to the one nozzle N in the Y-axis direction. In this variation, it is assumed as an example that the width Y1 of the wall 341 in the Y-axis direction is narrower than the width Y2 of the wall 321 in the Y-axis direction. On the surface of the vibrating section 36 on the −Z direction, the electrode 371 is provided so as to be common to the piezoelectric element 37 corresponding to one nozzle N and the piezoelectric element 37 corresponding to another nozzle N adjacent to the one nozzle N in the Y-axis direction.

Thus, in the example illustrated in FIG. 16, two sealing spaces 382, one of which accommodates the M piezoelectric elements 37 corresponding to the nozzle N1 and the other of which accommodates the M piezoelectric elements 37 corresponding to the nozzle N2, are provided in the head unit.

Figure 17:
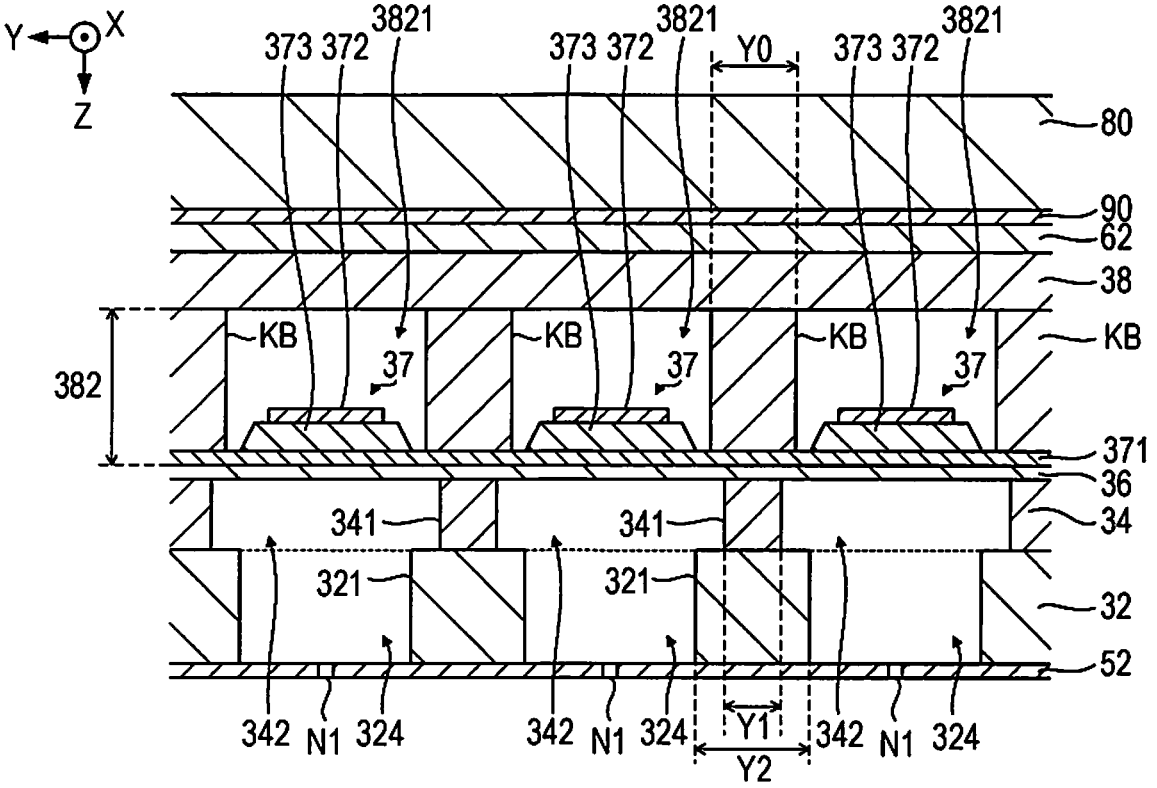
FIG. 17 is a cross-sectional view illustrating another example of the sealed space according to the sixth variation.

FIG. 17 illustrates another example of the sectional structure of the head unit 26 when the head unit 26 is cut along line XVII-XVII in FIG. 4.

The example in FIG. 17 differs from the example in FIG. 16 in that a wall KB is formed between the piezoelectric element 37 corresponding to one nozzle N and the piezoelectric element 37 corresponding to another nozzle N adjacent to the one nozzle N in the Y-axis direction. Specifically, in the example in FIG. 17, the sealing space 382 includes one space 3821 in which the piezoelectric element 37 corresponding to one nozzle N is provided, another space 3821 in which the piezoelectric element 37 corresponding to another nozzle N adjacent to the one nozzle N in the Y-axis direction, and the wall KB that separates the one space 3821 and the other space 3821 from each other. More specifically, the wall KB is disposed between the electrode 372 and piezoelectric layer 373 constituting the piezoelectric element 37 corresponding to one nozzle N and the electrode 372 and piezoelectric layer 373 constituting the piezoelectric element 37 corresponding to another nozzle N adjacent to the one nozzle N in the Y-axis direction, so as to mutually couple the rigid wiring substrate 38 and the electrode 371 common to the piezoelectric element 37 corresponding to the one nozzle N and the piezoelectric element 37 corresponding to the other nozzle N.

In the example in FIG. 17, it is assumed that the width Y0 of the wall KB in the Y-axis direction is wider than the width Y1 of the wall 341 in the Y-axis direction. Thus, in the example in FIG. 17, it is possible to make the amount deformation of the wall 341 between the pressure chamber corresponding to one nozzle N and the pressure chamber corresponding to another nozzle N adjacent to the one nozzle N in the Y-axis direction smaller and thereby to make a crosstalk generated between these two pressure chambers less than when, for example, the sealing space 382 lacks the wall KB or when the width Y0 is narrower than the width Y1.

In the example in FIG. 17, it is also assumed that the wall KB is formed from the same material as the rigid wiring substrate 38. However, the wall KB may be formed from a material different from the rigid wiring substrate 38.

In the example in FIG. 17, it is also assumed that a prescribed reference potential such as a ground potential is set for the electrode 371. In this case, the wall KB may be formed from the same material as the electrode 371.

Thus, in the example in FIG. 17, the head unit has 2M spaces 3821, which are M spaces 3821 that accommodate the M piezoelectric elements 37 corresponding to the nozzles N1 and M spaces 3821 that accommodate the M piezoelectric elements 37 corresponding to the nozzles N2.

Figure 18:
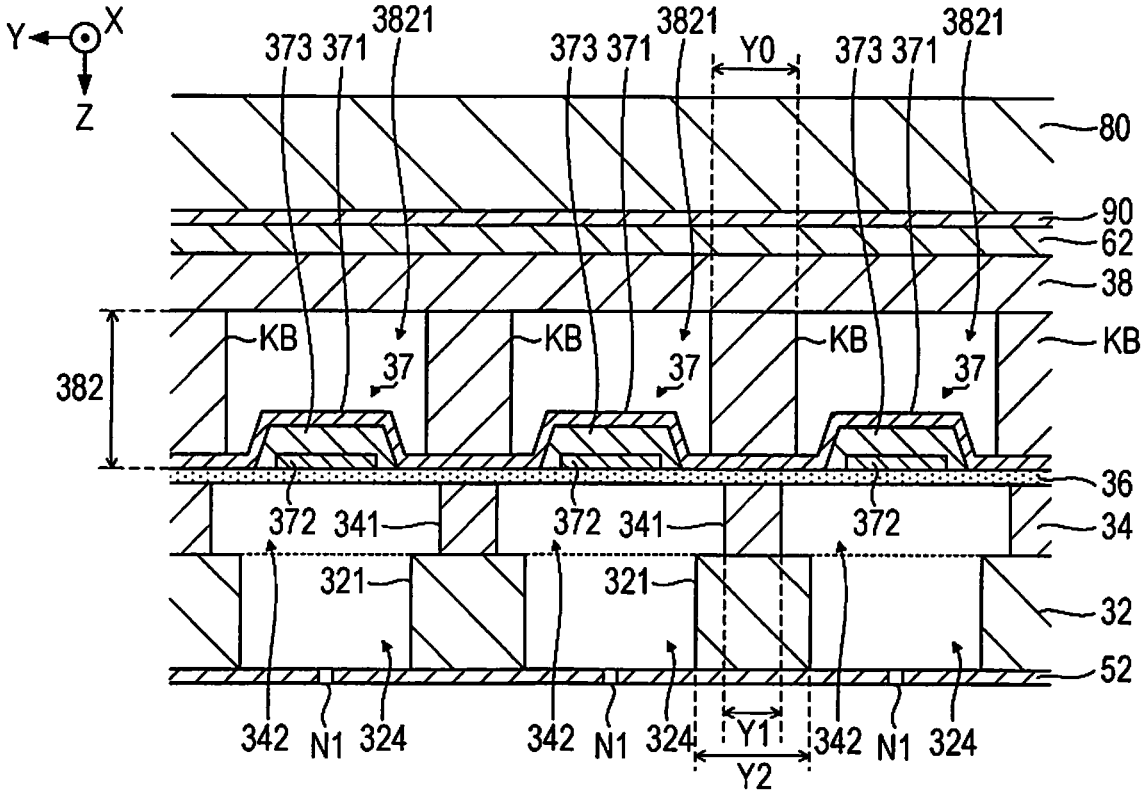
FIG. 18 is a cross-sectional view illustrating yet another example of the sealed space according to the sixth variation.

FIG. 18 illustrates another example of the sectional structure of the head unit 26 when the head unit 26 is cut along line XVIII-XVIII in FIG. 4.

Although, in the example in FIG. 17, the electrode 371 is disposed closer to the +Z side than is the piezoelectric layer 373 and the electrode 372 is disposed closer to the −Z side than is the piezoelectric layer 373, these positional relationships are reversed in the example in FIG. 18. That is, the electrode 371 is disposed closer to the −Z side than is the piezoelectric layer 373 and the electrode 372 is disposed closer to the +Z side than is the piezoelectric layer 373.

In the example in FIG. 18 as well, the wall KB is disposed between the piezoelectric element 37 corresponding to one nozzle N and the piezoelectric element 37 corresponding to another nozzle N adjacent to the one nozzle N in the Y-axis direction, so as to mutually couple the rigid wiring substrate 38 and the electrode 371 common to the piezoelectric element 37 corresponding to the one nozzle N and the piezoelectric element 37 corresponding to the other nozzle N, as in the example in FIG. 17.

Figure 19:
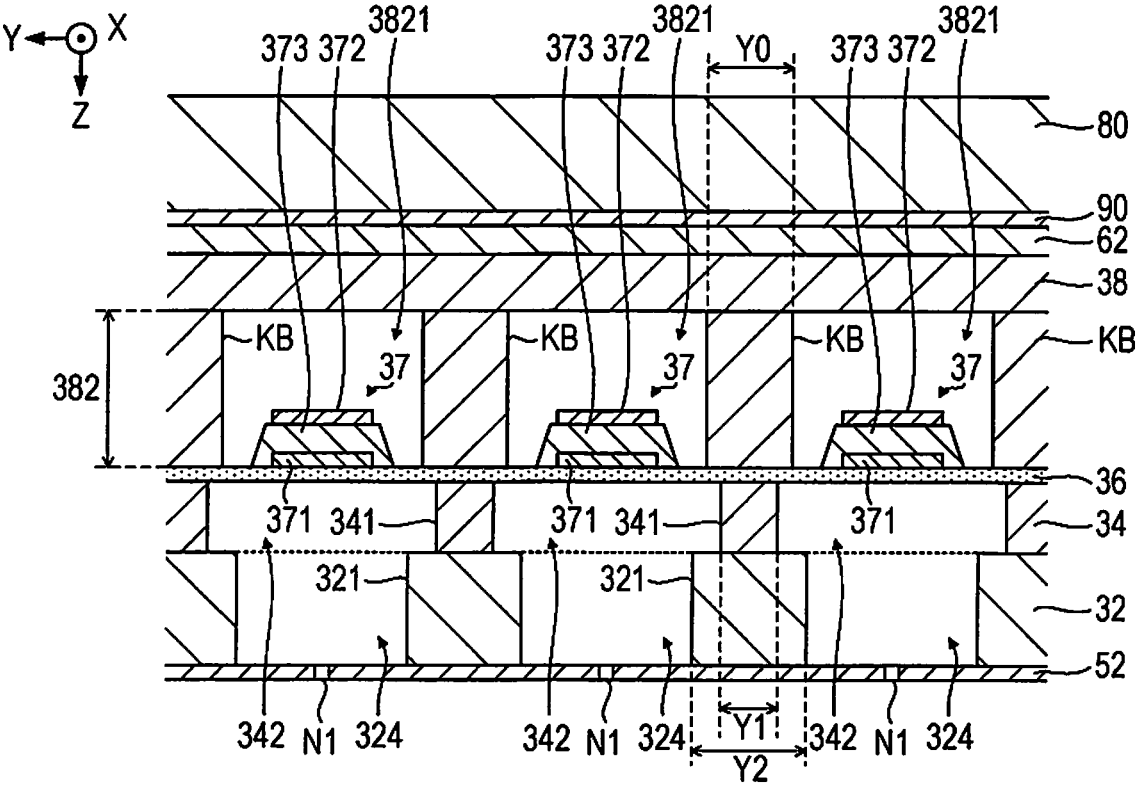
FIG. 19 is a cross-sectional view illustrating still another example of the sealed space according to the sixth variation.

FIG. 19 illustrates another example of the sectional structure of the head unit 26 when the head unit 26 is cut along line XIX-XIX in FIG. 4.

The example in FIG. 19 is similar to the example in FIG. 17, except that the wall KB is disposed so as to couple the vibrating section 36 and rigid wiring substrate 38 together. Specifically, in the example in FIG. 19, the wall KB is disposed between the piezoelectric element 37 corresponding to one nozzle N and the piezoelectric element 37 corresponding to another nozzle N adjacent to the one nozzle N in the Y-axis direction, so as to couple the vibrating section 36 and rigid wiring substrate 38 together.

In the example in FIG. 19, the wall KB may be formed from the same material as the rigid wiring substrate 38 or may be formed from the same material as the vibrating section 36.

Seventh Variation

In this variation, the head modules 260, 260A, and 260B in the embodiment and the first to sixth variations described above will be described in detail.

Figure 20:
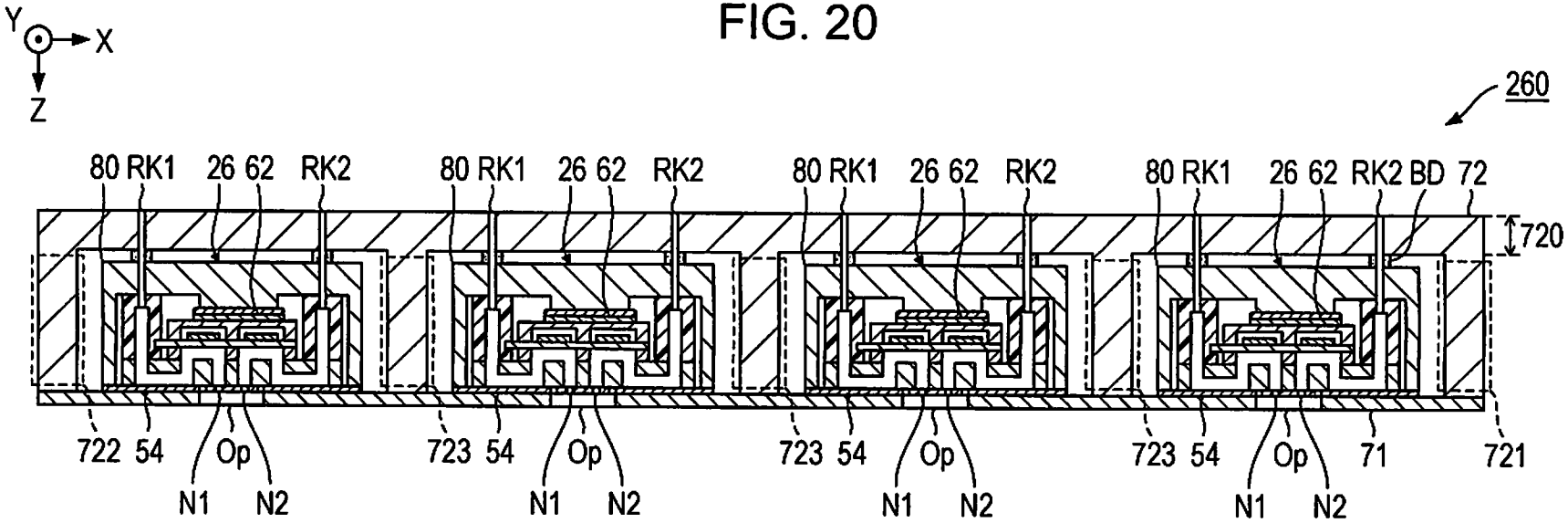
FIG. 20 is a cross-sectional view illustrating an example of the structure of a head module in a seventh variation.

FIG. 20 illustrates an example of the sectional structure of the head module 260 when the head module 260 is cut along line XX-XX in FIG. 2. Although, in this variation, the sectional structure of the head module 260 will be exemplified, the description in this variation similarly applies to the head modules 260A and 260B as well.

As illustrated in FIG. 20, the head module 260 has a plurality of head units 26, a support 71 that supports the plurality of head units 26 from the +Z side, and an accommodating body 72 disposed on the −Z side of the plurality of head units 26.

The support 71 is, for example, a plate-like member that extends in substantially parallel to an XY plane. The support 71 may be formed from, for example, a metal material such as stainless steel. The nozzle substrate 50 for each head unit 26 is fixed to the surface of the support 71 on the −Z side. Although not illustrated, the nozzle substrate 50 may have a fixture that fixes the vibration absorbing body 54 to the flow path substrate 32. In this case, the fixture provided for each head unit 26 may be fixed to the support 71.

In the support 71, an opening Op is formed on the +Z side of each nozzle N included in each head unit 26 fixed to the support 71. Specifically, the opening Op is formed in, for example, an area, on the support 71, in which the opening Op overlaps the nozzle plate 52 included in the head unit 26 when viewed from the +Z side. Therefore, the head unit 26 can land ink discharged from each nozzle N onto the medium 12 without being impeded by the support 71.

The accommodating body 72 has: a flat plate 720 positioned on the −Z side of the plurality of head units 26; a side wall 721 positioned closer to the +X side than are the plurality of head units 26, the side wall 721 coupling the flat plate 720 and support 71 together; a side wall 722 positioned closer to the −X side than are the plurality of head units 26, the side wall 722 coupling the flat plate 720 and support 71 together; and a plurality of partition plates 723 positioned between the side wall 721 and side wall 722, each partition plate 723 separating two of the plurality of head units 26, the two head units 26 being mutually adjacent in the X-axis direction, from each other. The accommodating body 72 may be formed from, for example, a metal material, such as aluminum or copper, that has higher thermal conductivity than the support 71. It is preferable for the accommodating body 72 to have thermal conductivity equal to or higher than the thermal conductivity of the external case 80.

In this variation, the external case 80 of each head unit 26 is fixed to the surface of the flat plate 720 on the +Z side with an adhesive BD. A through flow path RK1, through which ink is supplied from the liquid vessel 14 to the introduction port 831, and a through flow path RK2, through which ink is supplied from the liquid vessel 14 to the introduction port 832, are formed in the flat plate 720 and adhesive BD.

As described above, in this variation, the head module 260 has the support 71 that supports head units 26 and also has the accommodating body 72 fixed to the head units 26 and support 71. Accordingly, heat generated in the integrated circuit 62 is transferred to the accommodating body 72 through the external case 80, nozzle substrate 50, and support 71, and is also transferred to the accommodating body 72 through the external case 80 and adhesive BD. Since the accommodating body 72 is disposed so as to cover the plurality of head units 26, the accommodating body 72 has a larger surface area than each head unit 26. That is, the accommodating body 72 functions as a heat sink for the head unit 26. According to this variation, therefore, heat generated in the integrated circuit 62 can be more efficiently dissipated to the outside of the head module 260 than when the head module 260 lacks the support 71 and accommodating body 72.

When a head unit 26K that discharges black ink is included as one of the four head units 26, the head unit 26K is disposed between the side wall 721 and the partition plate 723 nearest to it or between the side wall 722 and the partition plate 723 nearest to it. That is, the head unit 26K is disposed at the end of the head module 260 on the +X side or −X side.

In print processing to form an image on the medium 12, black ink is generally more consumed than inks in other colors. Therefore, a change in the temperature or viscosity of black ink more greatly affects image quality than a change in the temperature or viscosity of inks in other colors.

Since, in this variation, the head unit 26K is disposed at an end of the head module 260, however, it is possible to reduce the extent to which image quality is lowered in print processing when compared with an aspect in which the head unit 26K is disposed at the center of the head module 260.

Figure 21:
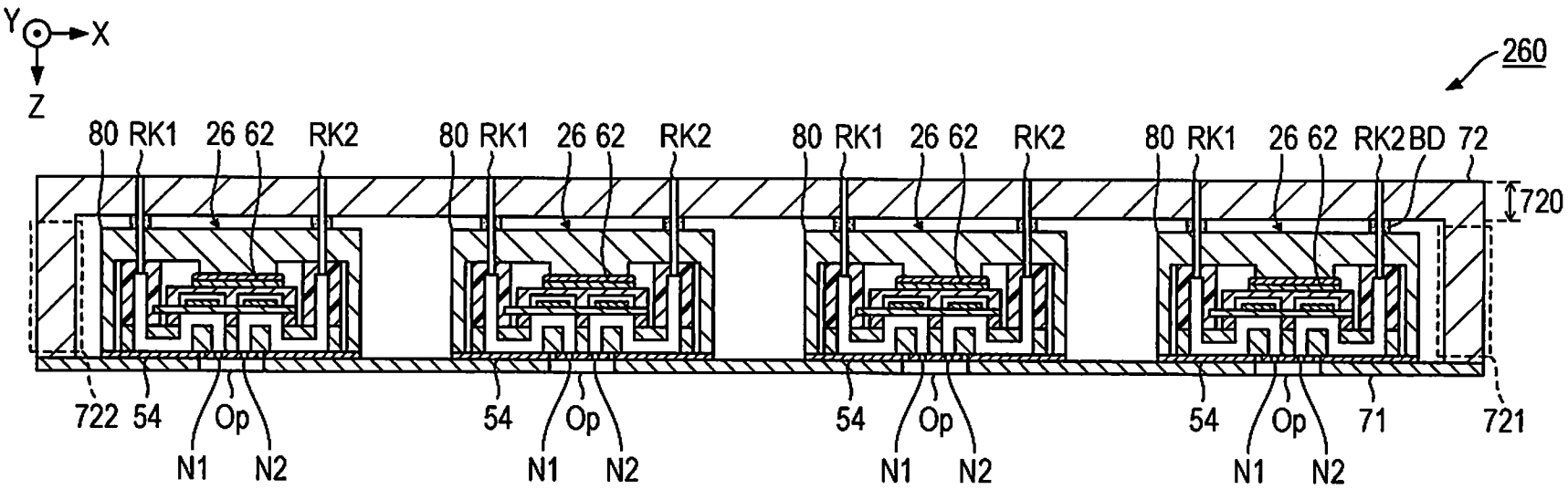
FIG. 21 is a cross-sectional view illustrating another example of the structure of the head module in the seventh variation.

Although, a case in which the accommodating body 72 has a plurality of partition plates 723 has been exemplified in FIG. 20, this variation is not limited to this aspect. For example, the accommodating body 72 may be structured without partition plates 723, as illustrated in FIG. 21.

Eight Variation

Although a structure in which the nozzle substrate 50 has the vibration absorbing body 54 has been exemplified in the embodiment and the first to seventh variations described above, the present disclosure is not limited to this aspect. The nozzle substrate 50 may be structured without the vibration absorbing body 54.

Ninth Variation

Although the piezoelectric element 37 has been exemplified as a constituent element that applies pressure to the interior of the pressure chamber in the embodiment and the first to eighth variations described above, the present disclosure is not limited to this aspect. As a constituent element that applies pressure to the interior of the pressure chamber, a heat generating element may be used that heats the pressure chamber to generate bubbles in the pressure chamber and thereby to change pressure in it. A heat generating element is a constituent element in which a heat generating body generates heat when a driving signal Com is supplied. As understood from the above exemplary examples, the constituent element that applies pressure to the interior of the pressure chamber only needs to be an element that discharges the liquid in the pressure chamber from the nozzle N, that is, an element that applies pressure to the interior of the pressure chamber; there is no limitation on the operation method or a specific structure.

Tenth Variation

The liquid-discharging apparatus exemplified in the embodiment and the first to ninth variations described above can be used not only in units specific to printing but also in other various units such as facsimile machines and copiers. Of course, applications of the liquid-discharging apparatus in the present disclosure are not limited to printing. For example, a liquid-discharging apparatus that discharges a solution of a color material is used a manufacturing apparatus that forms a color filter for a liquid crystal display unit. In another example, a liquid-discharging apparatus that discharges a solution of a conductive material is used as a manufacturing apparatus that forms wires and electrodes on a wiring board.

What is claimed is:

1. A head unit comprising:

a first member in which a pressure chamber that stores a liquid to be discharged from a nozzle is formed;

a piezoelectric element disposed on the first member, the piezoelectric element being configured to deform in response to a driving signal for varying a pressure of the liquid in the pressure chamber;

a first substrate configured to cover the piezoelectric element, the first substrate being disposed on the first member;

an integrated circuit configured to supply the driving signal to the piezoelectric element, the integrated circuit being disposed on the first substrate;

a second member disposed on the first member, the second member including a heat dissipation opening configured to dissipate heat of the integrated circuit; and a third member formed from a metal, the third member being disposed on the second member; wherein the third member has a concave portion, the concave portion having an upper lid, a first structural body, and a second structural body, the piezoelectric element, the integrated circuit, the first substrate, the first member, and the second member are disposed inside the concave portion of the third member, and the integrated circuit opposes to the third member through the heat dissipation opening, and the third member further has a convex portion disposed in the heat dissipation opening between the upper lid and the integrated circuit.

2. The head unit according to claim 1, wherein the second member is disposed so as to enclose the integrated circuit.

3. The head unit according to claim 1, wherein a distance between the third member and the integrated circuit is shorter than a distance between the integrated circuit and the piezoelectric element.

4. The head unit according to claim 1, wherein:

the piezoelectric element and the pressure chamber constitute a discharging section; and the head unit includes 800 or more discharging sections with a density of 400 or more discharging sections per inch.

5. The head unit according to claim 1, wherein a thermal conductivity of the third member is higher than a thermal conductivity of the liquid and is also higher than a thermal conductivity of the first substrate.

6. The head unit according to claim 1, wherein:

the piezoelectric element, the integrated circuit, and the first substrate are disposed between the first structural body and the second structural body.

7. The head unit according to claim 1, wherein the third member is provided so that the heat of the integrated circuit is transferred to the third member at a thermal conductivity equal to or higher than a prescribed thermal conductivity.

8. The head unit according to claim 1, further comprising a nozzle substrate on which the nozzle is formed, wherein the first structural body and the second structural body are fixed to the nozzle substrate so that heat of the nozzle substrate is transferred to the third member at a thermal conductivity equal to or higher than a prescribed thermal conductivity.

9. The head unit according to claim 1, wherein the second member includes a first holding chamber that holds the liquid and a second holding chamber that holds the liquid, and the piezoelectric element, the integrated circuit, and the first substrate are disposed between the first holding chamber and the second holding chamber.

10. The head unit according to claim 1, wherein:

a through-hole that passes through the first substrate is formed in the first substrate; and a coupling wire that electrically couples the integrated circuit and the piezoelectric element together is provided in the through-hole.

11. The head unit according to claim 1, wherein:

an exhausting chamber that holds the liquid exhausted from the pressure chamber is formed in the second member; and an exhausting flow path through which the liquid exhausted from the pressure chamber flows into the exhausting chamber is formed in the first member.

12. A liquid-discharging apparatus comprising:

a head module including a plurality of head units, each of the plurality of head units is the head unit according to claim 1; and a storage case configured to store the head module; wherein the storage case includes an intake port through which air outside the storage case is taken into the storage case, and an exhausting port having a fan that exhausts the air in the storage case to an outside of the storage case.

13. The head unit according to claim 1, wherein the nozzle is configured to discharge the liquid in a first direction, and the heat dissipation opening of the second member and the integrated circuit are disposed on a side of the first direction from the upper lid of the third member.

* * * * *